US008924222B2

(12) United States Patent
Rajendran et al.

(10) Patent No.: US 8,924,222 B2
(45) Date of Patent: Dec. 30, 2014

(54) SYSTEMS, METHODS, APPARATUS, AND COMPUTER-READABLE MEDIA FOR CODING OF HARMONIC SIGNALS

(75) Inventors: Vivek Rajendran, San Diego, CA (US); Ethan Robert Duni, San Diego, CA (US); Venkatesh Krishnan, San Diego, CA (US); Ashish Kumar Tawari, Bemetara (IN)

(73) Assignee: QUALCOMM Incorporated, San Diego, CA (US)

( * ) Notice: Subject to any disclaimer, the term of this patent is extended or adjusted under 35 U.S.C. 154(b) by 391 days.

(21) Appl. No.: 13/192,956

(22) Filed: Jul. 28, 2011

(65) Prior Publication Data

US 2012/0029923 A1 Feb. 2, 2012

Related U.S. Application Data

(60) Provisional application No. 61/369,662, filed on Jul. 30, 2010, provisional application No. 61/369,705, filed on Jul. 31, 2010, provisional application No. 61/369,751, filed on Aug. 1, 2010, provisional application No. 61/374,565, filed on Aug. 17, 2010, provisional application No. 61/384,237, filed on Sep. 17, 2010, provisional application No. 61/470,438, filed on Mar. 31, 2011.

(51) Int. Cl.

| | |
|---|---|
| ***G10L 19/00*** | (2013.01) |
| ***G10L 25/90*** | (2013.01) |
| ***G10L 19/038*** | (2013.01) |
| *G10L 19/093* | (2013.01) |

(52) U.S. Cl.

CPC ..... *G10L 25/90* (2013.01); *G10L 19/038* (2013.01); *G10L 19/093* (2013.01)

USPC ..... 704/501; 704/207

(58) Field of Classification Search

None

See application file for complete search history.

(56) References Cited

U.S. PATENT DOCUMENTS

| | | | | |
|---|---|---|---|---|
| 3,978,287 | A * | 8/1976 | Fletcher et al. | 704/231 |
| 4,516,258 | A | 5/1985 | Ching et al. | |
| 4,964,166 | A | 10/1990 | Wilson | |
| 5,222,146 | A | 6/1993 | Bahl et al. | |
| 5,309,232 | A | 5/1994 | Hartung et al. | |
| 5,321,793 | A | 6/1994 | Drogo De Iacovo et al. | |
| 5,388,181 | A | 2/1995 | Anderson et al. | |
| 5,479,561 | A | 12/1995 | Kim | |

(Continued)

FOREIGN PATENT DOCUMENTS

| | | | |
|---|---|---|---|
| CN | 1207195 | A | 2/1999 |
| CN | 1239368 | A | 12/1999 |

(Continued)

OTHER PUBLICATIONS

Piszczalski et al., "Predicting musical pitch from component frequency ratios", J. Acoust. Soc. Am. vol. 66, Issue 3, pp. 710-720 (1979).*

(Continued)

*Primary Examiner* — Brian Albertalli

(74) *Attorney, Agent, or Firm* — Austin Rapp & Hardman

(57) ABSTRACT

A scheme for coding a set of transform coefficients that represent an audio-frequency range of a signal uses a harmonic model to parameterize a relationship between the locations of regions of significant energy in the frequency domain.

58 Claims, 19 Drawing Sheets

(56) References Cited

U.S. PATENT DOCUMENTS

| | | | | |
|---|---|---|---|---|
| 5,630,011 | A | 5/1997 | Lim et al. | |
| 5,664,057 | A | 9/1997 | Crossman et al. | |
| 5,692,102 | A | 11/1997 | Pan | |
| 5,781,888 | A | 7/1998 | Herre | |
| 5,842,160 | A | 11/1998 | Zinser | |
| 5,962,102 | A | 10/1999 | Sheffield et al. | |
| 5,978,762 | A | 11/1999 | Smyth et al. | |
| 5,999,897 | A * | 12/1999 | Yeldener | 704/207 |
| 6,035,271 | A * | 3/2000 | Chen | 704/207 |
| 6,058,362 | A | 5/2000 | Malvar | |
| 6,064,954 | A | 5/2000 | Cohen et al. | |
| 6,078,879 | A * | 6/2000 | Taori et al. | 704/207 |
| 6,094,629 | A | 7/2000 | Grabb et al. | |
| 6,098,039 | A | 8/2000 | Nishida | |
| 6,236,960 | B1 | 5/2001 | Peng et al. | |
| 6,246,345 | B1 | 6/2001 | Davidson et al. | |
| 6,301,556 | B1 | 10/2001 | Hagen et al. | |
| 6,308,150 | B1 | 10/2001 | Neo et al. | |
| 6,424,939 | B1 | 7/2002 | Herre et al. | |
| 6,593,872 | B2 | 7/2003 | Makino et al. | |
| 6,766,288 | B1 * | 7/2004 | Smith | 704/207 |
| 6,952,671 | B1 | 10/2005 | Kolesnik et al. | |
| 7,069,212 | B2 | 6/2006 | Tanaka et al. | |
| 7,272,556 | B1 | 9/2007 | Aguilar et al. | |
| 7,310,598 | B1 | 12/2007 | Mikhael et al. | |
| 7,340,394 | B2 | 3/2008 | Chen et al. | |
| 7,493,254 | B2 * | 2/2009 | Jung et al. | 704/207 |
| 7,613,607 | B2 | 11/2009 | Valve et al. | |
| 7,660,712 | B2 | 2/2010 | Gao et al. | |
| 7,885,819 | B2 | 2/2011 | Koishida et al. | |
| 7,912,709 | B2 * | 3/2011 | Kim | 704/207 |
| 8,111,176 | B2 | 2/2012 | Tosato et al. | |
| 8,364,471 | B2 | 1/2013 | Yoon et al. | |
| 8,370,133 | B2 | 2/2013 | Taleb et al. | |
| 8,493,244 | B2 | 7/2013 | Satoh et al. | |
| 8,831,933 | B2 | 9/2014 | Duni et al. | |
| 2001/0023396 | A1 | 9/2001 | Gersho et al. | |
| 2002/0161573 | A1 | 10/2002 | Yoshida | |
| 2002/0169599 | A1 | 11/2002 | Suzuki | |
| 2003/0061055 | A1 | 3/2003 | Taori et al. | |
| 2003/0233234 | A1 | 12/2003 | Truman et al. | |
| 2004/0133424 | A1 * | 7/2004 | Ealey et al. | 704/233 |
| 2004/0196770 | A1 | 10/2004 | Touyama et al. | |
| 2005/0080622 | A1 | 4/2005 | Dieterich et al. | |
| 2006/0015329 | A1 | 1/2006 | Chu | |
| 2006/0036435 | A1 | 2/2006 | Kovesi et al. | |
| 2007/0271094 | A1 | 11/2007 | Ashley et al. | |
| 2007/0282603 | A1 | 12/2007 | Bessette | |
| 2007/0299658 | A1 * | 12/2007 | Wang et al. | 704/207 |
| 2008/0027719 | A1 | 1/2008 | Kirshnan et al. | |
| 2008/0052066 | A1 | 2/2008 | Oshikiri et al. | |
| 2008/0059201 | A1 | 3/2008 | Hsiao | |
| 2008/0097757 | A1 | 4/2008 | Vasilache | |
| 2008/0126904 | A1 | 5/2008 | Sung et al. | |
| 2008/0234959 | A1 | 9/2008 | Joublin et al. | |
| 2008/0310328 | A1 | 12/2008 | Li et al. | |
| 2008/0312758 | A1 | 12/2008 | Koishida et al. | |
| 2008/0312759 | A1 | 12/2008 | Koishida et al. | |
| 2008/0312914 | A1 | 12/2008 | Rajendran et al. | |
| 2009/0177466 | A1 | 7/2009 | Rui et al. | |
| 2009/0187409 | A1 | 7/2009 | Krishnan et al. | |
| 2009/0234644 | A1 | 9/2009 | Reznik et al. | |
| 2009/0271204 | A1 | 10/2009 | Tammi | |
| 2009/0299736 | A1 | 12/2009 | Sato | |
| 2009/0319261 | A1 | 12/2009 | Gupta et al. | |
| 2009/0326962 | A1 | 12/2009 | Chen et al. | |
| 2010/0017198 | A1 | 1/2010 | Yamanashi et al. | |
| 2010/0054212 | A1 | 3/2010 | Tang | |
| 2010/0121646 | A1 | 5/2010 | Ragot et al. | |
| 2010/0169081 | A1 | 7/2010 | Yamanashi et al. | |
| 2010/0280831 | A1 | 11/2010 | Salami et al. | |
| 2011/0173012 | A1 | 7/2011 | Rettelbach et al. | |
| 2011/0178795 | A1 | 7/2011 | Bayer et al. | |
| 2012/0029924 | A1 | 2/2012 | Duni et al. | |
| 2012/0029925 | A1 | 2/2012 | Duni et al. | |
| 2012/0029926 | A1 | 2/2012 | Krishnan et al. | |
| 2012/0046955 | A1 | 2/2012 | Rajendran et al. | |
| 2013/0013321 | A1 | 1/2013 | Oh et al. | |
| 2013/0117015 | A1 | 5/2013 | Bayer et al. | |
| 2013/0144615 | A1 | 6/2013 | Rauhala et al. | |
| 2013/0218577 | A1 | 8/2013 | Taleb et al. | |

FOREIGN PATENT DOCUMENTS

| | | | |
|---|---|---|---|
| CN | 1367618 | A | 9/2002 |
| CN | 101030378 | A | 9/2007 |
| CN | 101523485 | A | 9/2009 |
| CN | 101622661 | A | 1/2010 |
| JP | 63033935 | | 2/1988 |
| JP | S6358500 | A | 3/1988 |
| JP | H01205200 | A | 8/1989 |
| JP | H07273660 | A | 10/1995 |
| JP | H09244694 | A | 9/1997 |
| JP | H09288498 | A | 11/1997 |
| JP | H1097298 | A | 4/1998 |
| JP | H11502318 | A | 2/1999 |
| JP | 11-224099 | | 8/1999 |
| JP | 2001044844 | A | 2/2001 |
| JP | 2001249698 | A | 9/2001 |
| JP | 2002542522 | A | 12/2002 |
| JP | 2004163696 | A | 6/2004 |
| JP | 2004246038 | A | 9/2004 |
| JP | 2004538525 | A | 12/2004 |
| JP | 2005527851 | A | 9/2005 |
| JP | 2006301464 | A | 11/2006 |
| JP | 2007525707 | A | 9/2007 |
| JP | 2010518422 | A | 5/2010 |
| JP | 2011527455 | A | 10/2011 |
| WO | WO0315077 | A1 | 2/2003 |
| WO | WO-03088212 | A1 | 10/2003 |
| WO | WO-03107329 | A1 | 12/2003 |
| WO | WO-2009029036 | A1 | 3/2009 |
| WO | WO2010003565 | A1 | 1/2010 |
| WO | WO2010081892 | A2 | 7/2010 |

OTHER PUBLICATIONS

Adoul J-P, et al., "Baseband speech coding at 2400 BPS using spherical vector quantization", International Conference on Acoustics, Speech & Signal Processing. ICASSP. San Diego, Mar. 19-21, 1984; [International Conference on Acoustics, Speech & Signal Processing. ICASSP], New York, IEEE, US, vol. 1, Mar. 19, 1984, pp. 1.12/1-1.12/4, XP002301076.

Bartkowiak Maciej, et al., "Harmonic Sinusoidal + Noise Modeling of Audio Based on Multiple FO Estimation", AES Convention 125; Oct. 2008, AES, 60 East 42nd Street, Room 2520 New York 10165-2520, USA, Oct. 1, 2008, XP040508748.

Bartkwiak et al.,"A unifying Approach to Transfor, and Sinusoidal Coding of Audio", AES Convention 124; May 2008, AES, 60 East 42nd Street, Room 2520 New York 10165-2520, USA, May 1, 2008, XP040508700, Section 2.2-4, Figure 3.

Chunghsin Yeh, et al., " Multiple Fundamental Frequency Estimation of Polyphonic Music Signals", 2005 IEEE International Conference on Acoustics, Speech, and Signal Processing—Mar. 18-23, 2005—Philadelphia, PA, USA, IEEE, Piscataway, NJ, vol . 3, Mar. 18, 2005, pp. 225-228, XP010792370, DOI: 10.1109/ICASSP.2005.1415687 ISBN: 978-0-7803-8874-1.

Doval B, et al., "Estimation o f fundamental frequency of musical sound signals", Speech Processing 1. Toronto, May 14-17, 1991; [International Conference on Acoustics, Speech & Signal Processing. ICASSP], New York, IEEE, US, vol. CONF. 16, Apr. 14, 1991, pp. 3657-3660, XP010043661, DOI: 10.1109/ICASSP.1991.151067 ISBN: 978-0-7803-0003-3.

International Search Report and Written Opinion—PCT/US2011/045837—ISA/EPO—Feb. 13, 2012.

Lee D H et al: "Cell-conditioned multistage vector quantization", Speech Processing 1. Toronto, May 14-17, 1991; [International Conference on Acoustics, Speech & Signal Processing.ICASSP], New York, IEEE,US, vol. CONF.16, Apr. 14, 1991, pp. 653-656, XP010043060, DOI: 10.1109/ICASSP.1991.150424 ISBN: 978-0-7803-0003-3.

(56) References Cited

OTHER PUBLICATIONS

Paiva Rui Pedro, et al., "A Methodology for Detection of Melody in Polyphonic Musical Signals", AES Convention 116; May 2004, AES, 60 East 42nd Street, Room 2520 New York 10165-2520, USA, May 1, 2004—, XP040506771.
3GPP TS 26.290 v8.0.0.,"Audio codec processing functions; Extended Adaptive Multi-rate—Wideband (AMR-WB+) codec; Transcoding functions", Release 8, pp. 1-87, (Dec. 2008).
3GPP2 C.S00014-D, v2.0, "Enhanced Variable Rate Codec, Speech Service Options 3, 68, 70, and 73 for Wideband Spread Spectrum Digital Systems", 3GPP2 (3rd Generation Partnership Project 2), Telecommunications Industry Association, Arlington, VA., pp. 1-308 (Jan. 25, 2010).
Cardinal, J., "A fact full search equivalent for mean-shape-gain vector quantizers," 20th Symp. on Inf. Theory in the Benelux, 1999, 8 pp.
Etemoglu, et al., "Structured Vector Quantization Using Linear Transforms," IEEE Transactions on Signal Processing, vol. 51, No. 6, Jun. 2003, pp. 1625-1631.
ITU-T G.729.1 (May 2006), Series G: Transmission Systems and Media, Digital Systems and Networks, Digital terminal equipments—Coding of analogue signals by methods other than PCM, G.729-based embedded variable bit-rate coder: An 8-32 kbits/ scalable wideband coder bitstream interoperable with G.729, 100pp.
Matschkal, B. et al. "Joint Signal Processing for Spherical Logarithmic Quantization and DPCM," 6th Int'l ITG-Conf. on Source and Channel Coding, Apr. 2006, 6 pp.
Mehrotra S. et al., "Low Bitrate Audio Coding Using Generalized Adaptive Gain Shape Vector Quantization Across Channels", Proceeding ICASSP '09 Proceedings of the 2009 IEEE International Conference on Acoustics, Speech and Signal Processing, Apr. 2009, pp. 1-4, IEEE Computer Society.
Mittal U., et al. "Low Complexity Factorial Pulse Coding of MDCT Coefficients using Approximation of Combinatorial Functions", IEEE International Conference on Acoustics, Speech and Signal Processing, vol. 1, Apr. 15-20, 2007, pp. II-289 to II-292.
Murashima, A., et al., "A post-processing technique to improve coding quality of CELP under background noise" Proc. IEEE Workshop on Speech Coding, pp. 102-104 (Sep. 2000).
Oehler, K.L. et al., "Mean-gain-shape vector quantization," ICASSP 1993, pp. V-241-V-244.
Oger, M., et al., "Transform audio coding with arithmetic-coded scalar quantization and model-based bit allocation" ICASSP, pp. IV-545-IV-548 (2007).
Oshikiri, M. et al., "Efficient Spectrum Coding for Super-Wideband Speech and Its Application to 7/10/15 KHz Bandwidth Scalable Coders", Acoustics, Speech, and Signal Processing, 2004. Proceedings. (ICASSP '04). IEEE International Conference on, May 2004, pp. I-481-I-484, vol. 1.
Rongshan, Yu, et al., "High Quality Audio Coding Using a Novel Hybrid WLP-Subband Coding Algorithm," Fifth International Symposium on Signal Processing and its Applications, ISSPA '99, Brisbane, AU, Aug. 22-25, 1999, pp. 483-486.
Sampson, D., et al., "Fast lattice-based gain-shape vector quantisation for image-sequence coding," IEE Proc.-I, vol. 140, No. 1, Feb. 1993, pp. 56-66.
Terriberry, T.B. Pulse Vector Coding, 3 pp. Available online Jul. 22, 2011 at http://people.xiph.org/~tterribe/notes/cwrs.html.
Valin, J-M. et al., "A full-bandwidth audio codec with low complexity and very low delay," 5 pp. Available online Jul. 22, 2011 at http://jmvalin.ca/papers/celt_eusipco2009.pdf.
Valin, J-M. et al., "A High-Quality Speech and Audio Codec With Less Than 10 ms Delay," 10 pp., Available online Jul. 22, 2011 at http://jmvalin.ca/papers/celt_tasl.pdf, (published in IEEE Transactions on Audio, Speech, and Language Processing, vol. 18, No. 1, 2010, pp. 58-67).
Allott D., et al., "Shape adaptive activity controlled multistage gain shape vector quantisation of images." Electronics Letters, vol. 21, No. 9 (1985): 393-395.
Klapuri A., at el., "Multiple Fundamental Frequency Estimation by Summing Harmonic Amplitudes," in ISMIR, 2006, pp. 216-221.

* cited by examiner method MA110 method MD100

SYSTEMS, METHODS, APPARATUS, AND COMPUTER-READABLE MEDIA FOR CODING OF HARMONIC SIGNALS

CLAIM OF PRIORITY UNDER 35 U.S.C. §119

The present Application for Patent claims priority to Provisional Application No. 61/369,662, entitled "SYSTEMS, METHODS, APPARATUS, AND COMPUTER-READABLE MEDIA FOR EFFICIENT TRANSFORM-DOMAIN CODING OF AUDIO SIGNALS", filed Jul. 30, 2010. The present Application for Patent claims priority to Provisional Application No. 61/369,705, entitled "SYSTEMS, METHODS, APPARATUS, AND COMPUTER-READABLE MEDIA FOR DYNAMIC BIT ALLOCATION", filed Jul. 31, 2010. The present Application for Patent claims priority to Provisional Application No. 61/369,751, entitled "SYSTEMS, METHODS, APPARATUS, AND COMPUTER-READABLE MEDIA FOR MULTI-STAGE SHAPE VECTOR QUANTIZATION", filed Aug. 1, 2010. The present Application for Patent claims priority to Provisional Application No. 61/374,565, entitled "SYSTEMS, METHODS, APPARATUS, AND COMPUTER-READABLE MEDIA FOR GENERALIZED AUDIO CODING", filed Aug. 17, 2010. The present Application for Patent claims priority to Provisional Application No. 61/384,237, entitled "SYSTEMS, METHODS, APPARATUS, AND COMPUTER-READABLE MEDIA FOR GENERALIZED AUDIO CODING", filed Sep. 17, 2010. The present Application for Patent claims priority to Provisional Application No. 61/470,438, entitled "SYSTEMS, METHODS, APPARATUS, AND COMPUTER-READABLE MEDIA FOR DYNAMIC BIT ALLOCATION", filed Mar. 31, 2011.

BACKGROUND

1. Field

This disclosure relates to the field of audio signal processing.

2. Background

Coding schemes based on the modified discrete cosine transform (MDCT) are typically used for coding generalized audio signals, which may include speech and/or non-speech content, such as music. Examples of existing audio codecs that use MDCT coding include MPEG-1 Audio Layer 3 (MP3), Dolby Digital (Dolby Labs, London, UK; also called AC-3 and standardized as ATSC A/52), Vorbis (Xiph.Org Foundation, Somerville, Mass.), Windows Media Audio (WMA, Microsoft Corp., Redmond, Wash.), Adaptive Transform Acoustic Coding (ATRAC, Sony Corp., Tokyo, JP), and Advanced Audio Coding (AAC, as standardized most recently in ISO/IEC 14496-3:2009). MDCT coding is also a component of some telecommunications standards, such as Enhanced Variable Rate Codec (EVRC, as standardized in 3rd Generation Partnership Project 2 (3GPP2) document C.S0014-D v2.0, Jan. 25, 2010). The G.718 codec ("Frame error robust narrowband and wideband embedded variable bit-rate coding of speech and audio from 8-32 kbit/s", Telecommunication Standardization Sector (ITU-T), Geneva, CH, June 2008, corrected November 2008 and August 2009, amended March 2009 and March 2010) is one example of a multi-layer codec that uses MDCT coding.

SUMMARY

A method of audio signal processing according to a general configuration includes locating a plurality of peaks in a reference audio signal in a frequency domain. This method also includes selecting a number Nf of candidates for a fundamental frequency of a harmonic model, wherein each candidate is based on the location of a corresponding one of the plurality of peaks in the frequency domain. The method also includes, based on the locations of at least two of the plurality of peaks in the frequency domain, calculating a number Nd of harmonic spacing candidates. This method includes, for each of a plurality of different pairs of the fundamental frequency and harmonic spacing candidates, selecting a set of at least one subband of a target audio signal, wherein a location in the frequency domain of each subband in the set is based on the candidate pair. This method includes calculating, for each of the plurality of different pairs of candidates, an energy value from the corresponding set of at least one subband of the target audio signal, and based on at least a plurality of the calculated energy values, selecting a pair of candidates from among the plurality of different pairs of candidates. Computer-readable storage media (e.g., non-transitory media) having tangible features that cause a machine reading the features to perform such a method are also disclosed.

An apparatus for audio signal processing according to a general configuration includes means for locating a plurality of peaks in a reference audio signal in a frequency domain; means for selecting a number Nf of candidates for a fundamental frequency of a harmonic model, each based on the location of a corresponding one of the plurality of peaks in the frequency domain; and means for calculating a number Nd of candidates for a spacing between harmonics of the harmonic model, based on the locations of at least two of the peaks in the frequency domain. This apparatus also includes means for selecting, for each of a plurality of different pairs of the fundamental frequency and harmonic spacing candidates, a set of at least one subband of a target audio signal, wherein a location in the frequency domain of each subband in the set is based on the pair of candidates; and means for calculating, for each of the plurality of different pairs of candidates, an energy value from the corresponding set of at least one subband of the target audio signal. This apparatus also includes means for selecting a pair of candidates from among the plurality of different pairs of candidates, based on at least a plurality of the calculated energy values.

An apparatus for audio signal processing according to another general configuration includes a frequency-domain peak locator configured to locate a plurality of peaks in a reference audio signal in a frequency domain; a fundamental-frequency candidate selector configured to select a number Nf of candidates for a fundamental frequency of a harmonic model, each based on the location of a corresponding one of the plurality of peaks in the frequency domain; and a distance calculator configured to calculate a number Nd of candidates for a spacing between harmonics of the harmonic model, based on the locations of at least two of the peaks in the frequency domain. This apparatus also includes a subband placement selector configured to select, for each of a plurality of different pairs of the fundamental frequency and harmonic spacing candidates, a set of at least one subband of a target audio signal, wherein a location in the frequency domain of each subband in the set is based on the pair of candidates; and an energy calculator configured to calculate, for each of the plurality of different pairs of candidates, an energy value from the corresponding set of at least one subband of the target audio signal. This apparatus also includes a candidate pair selector configured to select a pair of candidates from among the plurality of different pairs of candidates, based on at least a plurality of the calculated energy values.

DETAILED DESCRIPTION

Figure 1A:
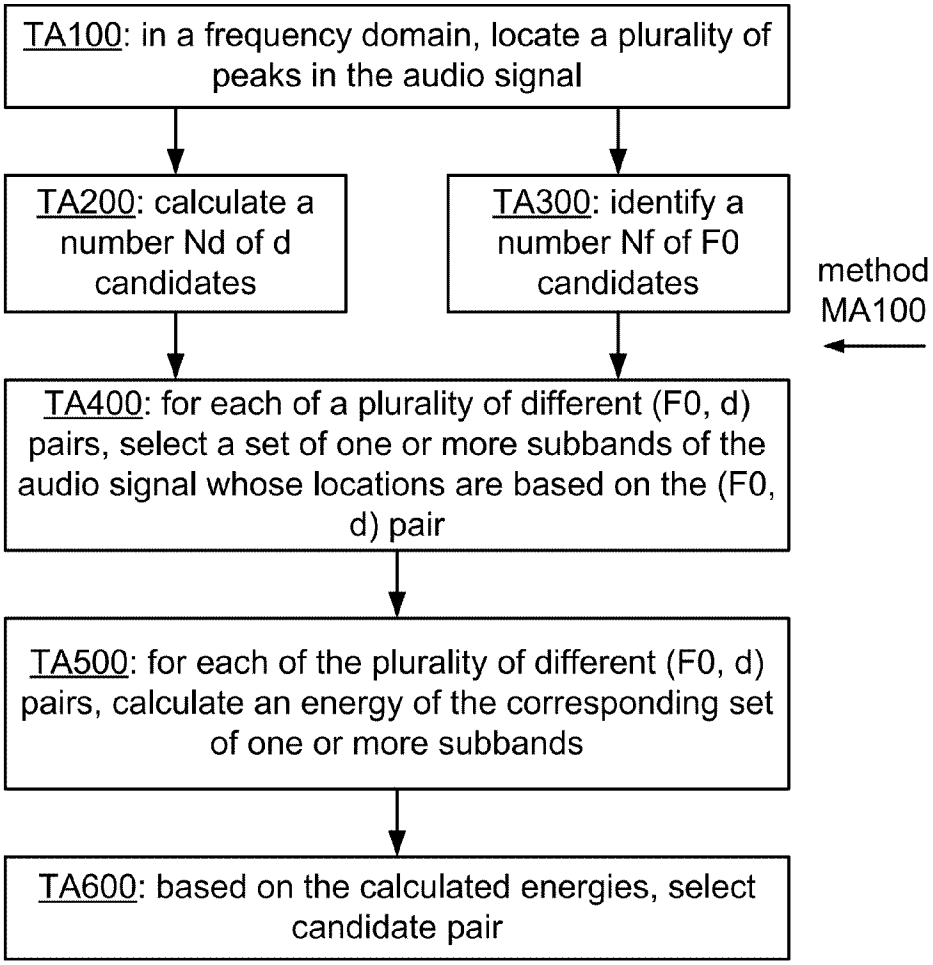
FIG. 1A shows a flowchart for a method MA100 of processing an audio signal according to a general configuration.

It may be desirable to identify regions of significant energy within a signal to be encoded. Separating such regions from the rest of the signal enables targeted coding of these regions for increased coding efficiency. For example, it may be desirable to increase coding efficiency by using relatively more bits to encode such regions and relatively fewer bits (or even no bits) to encode other regions of the signal.

For audio signals having high harmonic content (e.g., music signals, voiced speech signals), the locations of regions of significant energy in the frequency domain may be related. It may be desirable to perform efficient transform-domain coding of an audio signal by exploiting such harmonicity.

A scheme as described herein for coding a set of transform coefficients that represent an audio-frequency range of a signal exploits harmonicity across the signal spectrum by using a harmonic model to parameterize a relationship between the locations of regions of significant energy in the frequency domain. The parameters of this harmonic model may include the location of the first of these regions (e.g., in order of increasing frequency) and a spacing between successive regions. Estimating the harmonic model parameters may include generating a pool of candidate sets of parameter values and selecting a set of model parameter values from among the generated pool. In a particular application, such a scheme is used to encode MDCT transform coefficients corresponding to the 0-4 kHz range (henceforth referred to as the low-band MDCT, or LB-MDCT) of an audio signal, such as a residual of a linear prediction coding operation.

Separating the locations of regions of significant energy from their content allows a representation of a harmonic relationship among the locations of these regions to be transmitted to the decoder using minimal side information (e.g., the parameter values of the harmonic model). Such efficiency may be especially important for low-bit-rate applications, such as cellular telephony.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least".

Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method", "process", "procedure", and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose". Any incorporation by reference of a portion of a document shall also be understood to incorporate definitions of terms or variables that are referenced within the portion, where such definitions appear elsewhere in the document, as well as any figures referenced in the incorporated portion.

The systems, methods, and apparatus described herein are generally applicable to coding representations of audio signals in a frequency domain. A typical example of such a representation is a series of transform coefficients in a transform domain. Examples of suitable transforms include discrete orthogonal transforms, such as sinusoidal unitary transforms. Examples of suitable sinusoidal unitary transforms include the discrete trigonometric transforms, which include without limitation discrete cosine transforms (DCTs), discrete sine transforms (DSTs), and the discrete Fourier transform (DFT). Other examples of suitable transforms include lapped versions of such transforms. A particular example of a suitable transform is the modified DCT (MDCT) introduced above.

Reference is made throughout this disclosure to a "lowband" and a "highband" (equivalently, "upper band") of an audio frequency range, and to the particular example of a lowband of zero to four kilohertz (kHz) and a highband of 3.5 to seven kHz. It is expressly noted that the principles discussed herein are not limited to this particular example in any way, unless such a limit is explicitly stated. Other examples (again without limitation) of frequency ranges to which the application of these principles of encoding, decoding, allocation, quantization, and/or other processing is expressly contemplated and hereby disclosed include a lowband having a lower bound at any of 0, 25, 50, 100, 150, and 200 Hz and an upper bound at any of 3000, 3500, 4000, and 4500 Hz, and a highband having a lower bound at any of 3000, 3500, 4000, 4500, and 5000 Hz and an upper bound at any of 6000, 6500, 7000, 7500, 8000, 8500, and 9000 Hz. The application of such principles (again without limitation) to a highband having a lower bound at any of 3000, 3500, 4000, 4500, 5000, 5500, 6000, 6500, 7000, 7500, 8000, 8500, and 9000 Hz and an upper bound at any of 10, 10.5, 11, 11.5, 12, 12.5, 13, 13.5, 14, 14.5, 15, 15.5, and 16 kHz is also expressly contemplated and hereby disclosed. It is also expressly noted that although a highband signal will typically be converted to a lower sampling rate at an earlier stage of the coding process (e.g., via resampling and/or decimation), it remains a highband signal and the information it carries continues to represent the highband audio-frequency range. For a case in which the lowband and highband overlap in frequency, it may be desirable to zero out the overlapping portion of the lowband, to zero out the overlapping portion of the highband, or to cross-fade from the lowband to the highband over the overlapping portion.

A coding scheme as described herein may be applied to code any audio signal (e.g., including speech). Alternatively, it may be desirable to use such a coding scheme only for non-speech audio (e.g., music). In such case, the coding scheme may be used with a classification scheme to determine the type of content of each frame of the audio signal and select a suitable coding scheme.

A coding scheme as described herein may be used as a primary codec or as a layer or stage in a multi-layer or multi-stage codec. In one such example, such a coding scheme is used to code a portion of the frequency content of an audio signal (e.g., a lowband or a highband), and another coding scheme is used to code another portion of the frequency content of the signal. In another such example, such a coding scheme is used to code a residual (i.e., an error between the original and encoded signals) of another coding layer.

FIG. 1A shows a flowchart for a method MA100 of processing an audio signal according to a general configuration that includes tasks TA100, TA200, TA300, TA400, TA500, and TA600. Method MA100 may be configured to process the audio signal as a series of segments (e.g., by performing an instance of each of tasks TA100, TA200, TA300, TA400, TA500, and TA600 for each segment). A segment (or "frame") may be a block of transform coefficients that corresponds to a time-domain segment with a length typically in the range of from about five or ten milliseconds to about forty or fifty milliseconds. The time-domain segments may be overlapping (e.g., with adjacent segments overlapping by 25% or 50%) or nonoverlapping.

It may be desirable to obtain both high quality and low delay in an audio coder. An audio coder may use a large frame size to obtain high quality, but unfortunately a large frame size typically causes a longer delay. Potential advantages of an audio encoder as described herein include high quality coding with short frame sizes (e.g., a twenty-millisecond frame size, with a ten-millisecond lookahead). In one particular example, the time-domain signal is divided into a series of twenty-millisecond nonoverlapping segments, and the MDCT for each frame is taken over a forty-millisecond window that overlaps each of the adjacent frames by ten milliseconds.

A segment as processed by method MA100 may also be a portion (e.g., a lowband or highband) of a block as produced by the transform, or a portion of a block as produced by a previous operation on such a block. In one particular example, each of a series of segments processed by method MA100 contains a set of 160 MDCT coefficients that represent a lowband frequency range of 0 to 4 kHz. In another particular example, each of a series of segments processed by method MA100 contains a set of 140 MDCT coefficients that represent a highband frequency range of 3.5 to 7 kHz.

Task TA100 locates a plurality of peaks in the audio signal in a frequency domain. Such an operation may also be referred to as "peak-picking". Task TA100 may be configured to select a particular number of the highest peaks from the entire frequency range of the signal. Alternatively, task TA100 may be configured to select peaks from a specified frequency range of the signal (e.g., a low frequency range) or may be configured to apply different selection criteria in different frequency ranges of the signal. In a particular example as described herein, task TA100 is configured to locate at least a first number (Nd+1) of the highest peaks in the frame, including at least a second number Nf of the highest peaks in a low-frequency range of the frame.

Figure 2A:
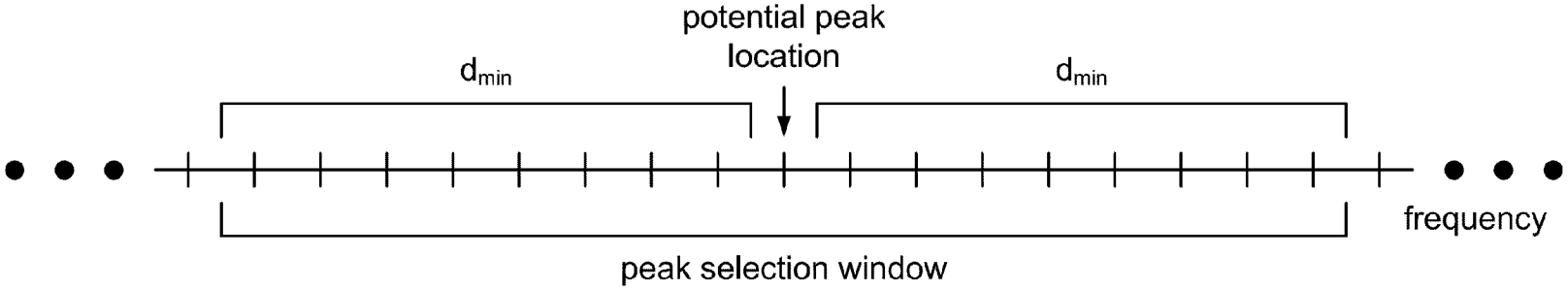
FIG. 2A illustrates an example of a peak selection window.

Task TA100 may be configured to identify a peak as a sample of the frequency-domain signal (also called a "bin") that has the maximum value within some minimum distance to either side of the sample. In one such example, task TA100 is configured to identify a peak as the sample having the maximum value within a window of size ($2d_{min}+1$) that is centered at the sample, where $d_{min}$ is a minimum allowed spacing between peaks. The value of $d_{min}$ may be selected according to a maximum desired number of regions of significant energy (also called "subbands") to be located. Examples of $d_{min}$ include eight, nine, ten, twelve, and fifteen samples (alternatively, 100, 125, 150, 175, 200, or 250 Hz), although any value suitable for the desired application may be used. FIG. 2A illustrates an example of a peak selection window of size ($2d_{min}+1$), centered at a potential peak location of the signal, for a case in which the value of $d_{min}$ is eight.

Based on the frequency-domain locations of at least some (i.e., at least three) of the peaks located by task TA100, task TA200 calculates a number Nd of harmonic spacing candidates (also called "distance" or d candidates). Examples of values for Nd include five, six, and seven. Task TA200 may be configured to compute these spacing candidates as the distances (e.g., in terms of number of frequency bins) between adjacent ones of the (Nd+1) largest peaks located by task TA100.

Based on the frequency-domain locations of at least some (i.e., at least two) of the peaks located by task TA100, task TA300 identifies a number Nf of candidates for the location of the first subband (also called "fundamental frequency" or F0 candidates). Examples of values for Nf include five, six, and seven. Task TA300 may be configured to identify these candidates as the locations of the Nf highest peaks in the signal. Alternatively, task TA300 may be configured to identify these candidates as the locations of the Nf highest peaks in a low-frequency portion (e.g., the lower 30, 35, 40, 45, or 50 percent) of the frequency range being examined. In one such example, task TA300 identifies the number Nf of F0 candidates from among the locations of peaks located by task TA100 in the range of from 0 to 1250 Hz. In another such example, task TA300 identifies the number Nf of F0 candidates from among the locations of peaks located by task TA100 in the range of from 0 to 1600 Hz.

It is expressly noted that the scope of described implementations of method MA100 includes the case in which only one harmonic spacing candidate is calculated (e.g., as the distance between the largest two peaks, or the distance between the largest two peaks in a specified frequency range) and the separate case in which only one F0 candidate is identified (e.g., as the location of the highest peak, or the location of the highest peak in a specified frequency range).

For each of a plurality of active pairs of the F0 and d candidates, task TA400 selects a set of at least one subband of the audio signal, wherein a location in the frequency domain of each subband in the set is based on the (F0, d) pair. In one example, task TA400 is configured to select the subbands of each set such that the first subband is centered at the corresponding F0 location, with the center of each subsequent subband being separated from the center of the previous subband by a distance equal to the corresponding value of d.

Task TA400 may be configured to select each set to include all of the subbands indicated by the corresponding (F0,d) pair that lie within the input range. Alternatively, task TA400 may be configured to select fewer than all of these subbands for at least one of the sets. Task TA400 may be configured, for example, to select not more than a maximum number of subbands for the set. Alternatively or additionally, task TA400 may be configured to select only subbands that lie within a particular range. Subbands at lower frequencies tend to be more important perceptually, for example, such that it may be desirable to configure task TA400 to select not more than a particular number of one or more (e.g., four, five, or six) of the lowest-frequency subbands in the input range and/or only subbands whose locations are not above a particular frequency within the input range (e.g., 1000, 1500, or 2000 Hz).

Task TA400 may be implemented to select subbands of fixed and equal length. In a particular example, each subband has a width of seven frequency bins (e.g., 175 Hz, for a bin spacing of twenty-five Hz). However, it is expressly contemplated and hereby disclosed that the principles described herein may also be applied to cases in which the lengths of the subbands may vary from one frame to another, and/or in which the lengths of two or more (possibly all) of the subbands within a frame may differ.

In one example, all of the different pairs of values of F0 and d are considered to be active, such that task TA400 is configured to select a corresponding set of one or more subbands for every possible (F0, d) pair. For a case in which Nf and Nd are both equal to seven, for example, task TA400 may be configured to consider each of the forty-nine possible pairs. For a case in which Nf is equal to five and Nd is equal to six, task TA400 may be configured to consider each of the thirty possible pairs. Alternatively, task TA400 may be configured to impose a criterion for activity that some of the possible (F0, d) pairs may fail to meet. In such case, for example, task TA400 may be configured to ignore pairs that would produce more than a maximum allowable number of subbands (e.g., combinations of low values of F0 and d) and/or pairs that would produce less than a minimum desired number of subbands (e.g., combinations of high values of F0 and d).

For each of a plurality of pairs of the F0 and d candidates, task TA500 calculates at least one energy value from the corresponding set of one or more subbands of the audio signal. In one such example, task TA500 calculates an energy value from each set of one or more subbands as the total energy of the set of subbands (e.g., as a sum of the squared magnitudes of the frequency-domain sample values in the subbands). Alternatively or additionally, task TA500 may be configured to calculate energy values from each set of subbands as the energies of each individual subband and/or to calculate an energy value from each set of subbands as an average energy per subband (e.g., total energy normalized over the number of subbands) for the set of subbands. Task TA500 may be configured to execute for each of the same plurality of pairs as task TA400 or for fewer than this plurality. For a case in which task TA400 is configured to select a set of subbands for each possible (F0, d) pair, for example, task TA500 may be configured to calculate energy values only for pairs that satisfy a specified criterion for activity (e.g., to ignore pairs that would produce too many subbands and/or pairs that would produce too few subbands, as described above). In another example, task TA400 is configured to ignore pairs that would produce too many subbands and task TA500 is configured to also ignore pairs that would produce too few subbands.

Although FIG. 1A shows execution of tasks TA400 and TA500 in series, it will be understood that task TA500 may also be implemented to begin to calculate energies for sets of subbands before task TA400 has completed. For example, task TA500 may be implemented to begin to calculate (or even to finish calculating) an energy value from a set of subbands before task TA400 begins to select the next set of subbands. In one such example, tasks TA400 and TA500 are configured to alternate for each of the plurality of active pairs of the F0 and d candidates Likewise, task TA400 may also be implemented to begin execution before task TA200 and TA300 have completed.

Based on calculated energy values from at least some of the sets of one or more subbands, task TA600 selects a candidate pair from among the (F0, d) candidate pairs. In one example, task TA600 selects the pair corresponding to the set of subbands having the highest total energy. In another example, task TA600 selects the candidate pair corresponding to the set of subbands having the highest average energy per subband.

Figure 1B:
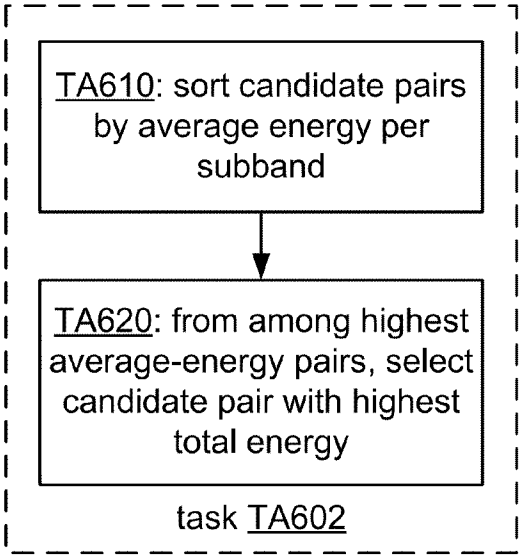
FIG. 1B shows a flowchart for an implementation TA602 of task TA600.

FIG. 1B shows a flowchart for a further implementation TA602 of task TA600. Task TA620 includes a task TA610 that sorts the plurality of active candidate pairs according to the average energy per subband of the corresponding sets of subbands (e.g., in descending order). This operation helps to inhibit selection of candidate pairs that produce subband sets having a high total energy but in which one or more subbands may have too little energy to be perceptually significant. Such a condition may indicate an excessive number of subbands.

Task TA602 also includes a task TA620 that selects, from among the Pv candidate pairs that produce the subband sets having the highest average energies per subband, the candidate pair associated with the subband set that captures the most total energy. This operation helps to inhibit selection of candidate pairs that produce subband sets that have a high average energy per subband but too few subbands. Such a condition may indicate that the set of subbands fails to include regions of the signal that have lower energy but may still be perceptually significant.

Task TA620 may be configured to use a fixed value for Pv, such as four, five, six, seven, eight, nine, or ten. Alternatively, task TA620 may be configured to use a value of Pv that is related to the total number of active candidate pairs (e.g., equal to or not more than ten, twenty, or twenty-five percent of the total number of active candidate pairs).

Figure 3A:
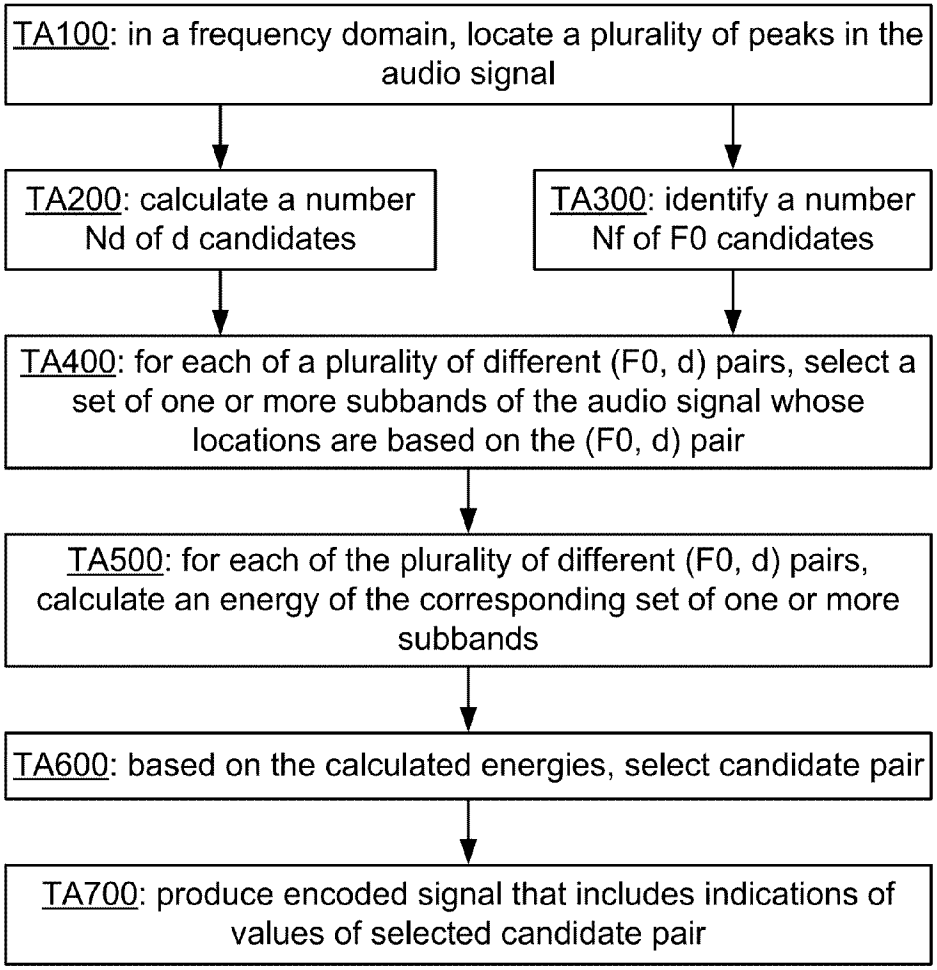
FIG. 3A shows a flowchart of an implementation MA110 of method MA100.

The selected values of F0 and d comprise model side information which are integer values and can be transmitted to the decoder using a finite number of bits. FIG. 3 shows a flowchart of an implementation MA110 of method MA100 that includes a task TA700. Task TA700 produces an encoded signal that includes indications of the values of the selected candidate pair. Task TA700 may be configured to encode the selected value of F0, or to encode an offset of the selected value of F0 from a minimum (or maximum) location. Similarly, task TA700 may be configured to encode the selected value of d, or to encode an offset of the selected value of d from a minimum or maximum distance. In a particular example, task TA700 uses six bits to encode the selected F0 value and six bits to encode the selected d value. In further examples, task TA700 may be implemented to encode the current value of F0 and/or d differentially (e.g., as an offset relative to a previous value of the parameter).

It may be desirable to implement task TA700 to use a vector quantization (VQ) coding scheme to encode the contents of the regions of significant energy identified by the selected candidate pair (i.e., the values within each of the selected set of subbands) as vectors. A VQ scheme encodes a vector by matching it to an entry in each of one or more codebooks (which are also known to the decoder) and using the index or indices of these entries to represent the vector. The length of a codebook index, which determines the maximum number of entries in the codebook, may be any arbitrary integer that is deemed suitable for the application.

One example of a suitable VQ scheme is gain-shape VQ (GSVQ), in which the contents of each subband is decomposed into a normalized shape vector (which describes, for example, the shape of the subband along the frequency axis) and a corresponding gain factor, such that the shape vector and the gain factor are quantized separately. The number of bits allocated to encoding the shape vectors may be distributed uniformly among the shape vectors of the various subbands. Alternatively, it may be desirable to allocate more of the available bits to encoding shape vectors that capture more energy than others, such as shape vectors whose corresponding gain factors have relatively high values as compared to the gain factors of the shape vectors of other subbands.

It may be desirable to use a GSVQ scheme that includes predictive gain coding such that the gain factors for each set of subbands are encoded independently from one another and differentially with respect to the corresponding gain factor of the previous frame. In a particular example, method MA110 is arranged to encode regions of significant energy in a frequency range of an LB-MDCT spectrum.

Figure 3B:
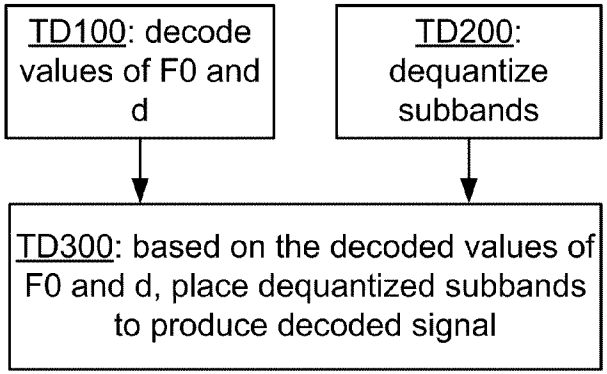
FIG. 3B shows a flowchart of a method MD100 of decoding an encoded signal.

FIG. 3B shows a flowchart of a corresponding method MD100 of decoding an encoded signal (e.g., as produced by task TA700) that includes tasks TD100, TD200, and TD300. Task TD100 decodes the values of F0 and d from the encoded signal, and task TD200 dequantizes the set of subbands. Task TD300 constructs the decoded signal by placing each dequantized subband in the frequency domain, based on the decoded values of F0 and d. For example, task TD300 may be implemented to construct the decoded signal by centering each subband m at the frequency-domain location F0+md, where $0<=m<M$ and M is the number of subbands in the selected set. Task TD300 may be configured to assign zero values to unoccupied bins of the decoded signal or, alternatively, to assign values of a decoded residual as described herein to unoccupied bins of the decoded signal.

In a harmonic coding mode, placing the regions in appropriate locations may be critical for efficient coding. It may be desirable to configure the coding scheme to capture the greatest amount of the energy in the given frequency range using the least number of subbands.

Figure 4:
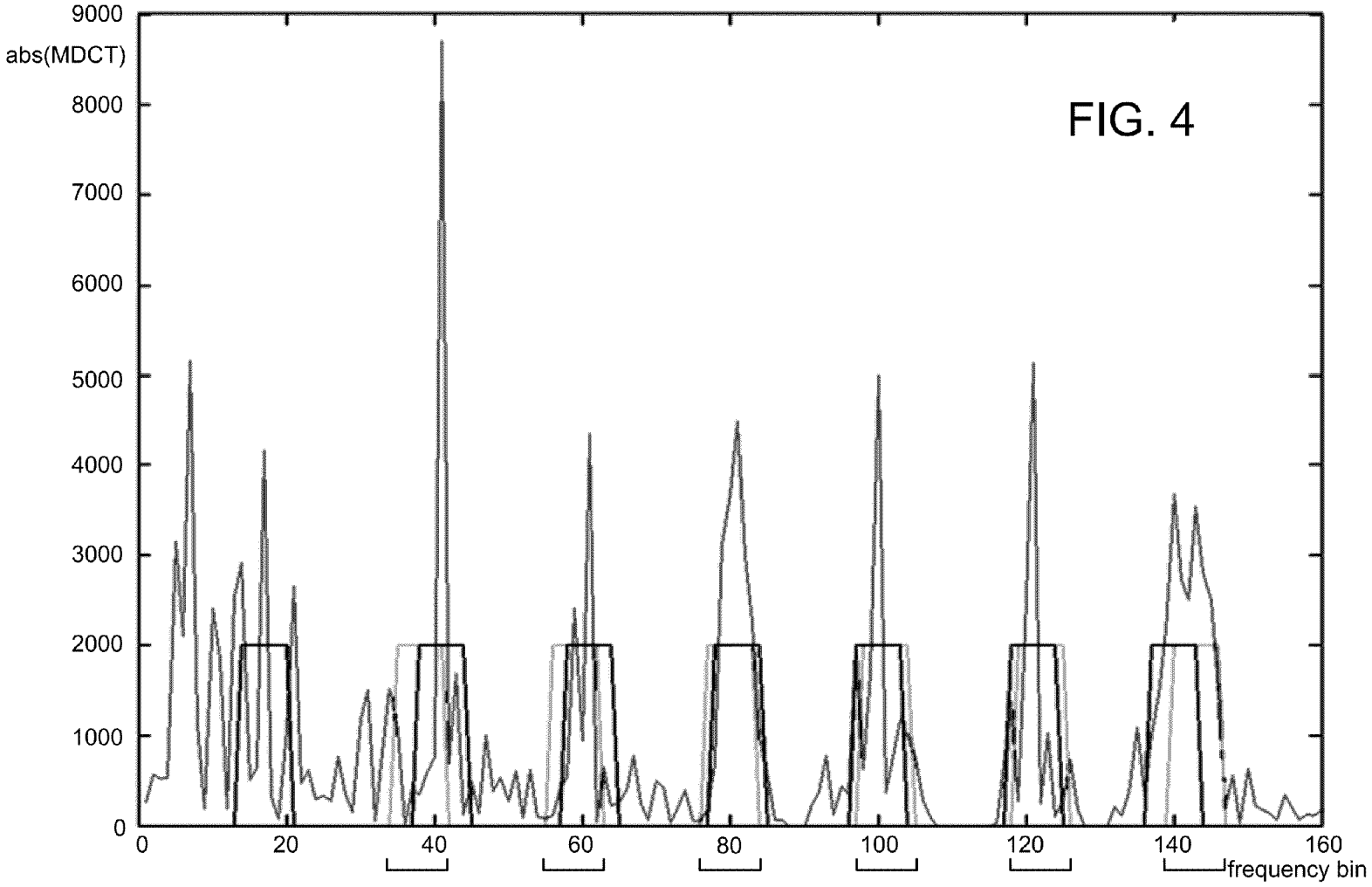
FIG. 4 shows a plot of an example of a harmonic signal and alternate sets of selected subbands.

FIG. 4 shows a plot of absolute transform coefficient value vs. frequency bin index for one example of a harmonic signal in the MDCT domain. FIG. 4 also shows frequency-domain locations for two possible sets of subbands for this signal. The locations of the first set of subbands are shown by the uniformly-spaced blocks, which are drawn in gray and are also indicated by the brackets below the x axis. This set corresponds to the (F0, d) candidate pair as selected by method MA100. It may be seen in this example that while the locations of the peaks in the signal appear regular, they do not conform exactly to the uniform spacing of the subbands of the harmonic model. In fact, the model in this case nearly misses the highest peak of the signal. Accordingly, it may be expected that a model that is strictly configured according to even the best (F0, d) candidate pair may fail to capture some of the energy at one or more of the signal peaks.

It may be desirable to implement method MA100 to accommodate non-uniformities in the audio signal by relaxing the harmonic model. For example, it may be desirable to allow one or more of the harmonically related subbands of a set (i.e., subbands located at F0, F0+d, F0+2d, etc.) to shift by a finite number of bins in each direction. In such case, it may be desirable to implement task TA400 to allow the location of one or more of the subbands to deviate by a small amount (also called a shift or "jitter") from the location indicated by the (F0, d) pair. The value of such a shift may be selected so that the resulting subband captures more of the energy of the peak.

Examples for the amount of jitter allowed for a subband include twenty-five, thirty, forty, and fifty percent of the subband width. The amount of jitter allowed in each direction of the frequency axis need not be equal. In a particular example, each seven-bin subband is allowed to shift its initial position along the frequency axis, as indicated by the current (F0, d) candidate pair, up to four frequency bins higher or up to three frequency bins lower. In this example, the selected jitter value for the subband may be expressed in three bits. It is also possible for the range of allowable jitter values to be a function of F0 and/or d.

The shift value for a subband may be determined as the value which places the subband to capture the most energy. Alternatively, the shift value for a subband may be determined as the value which centers the maximum sample value within the subband. It may be seen that the relaxed subband locations in FIG. 4, as indicated by the black-lined blocks, are placed according to such a peak-centering criterion (as shown most clearly with reference to the second and last peaks from left to right). A peak-centering criterion tends to produce less variance among the shapes of the subbands, which may lead to better GSVQ coding. A maximum-energy criterion may increase entropy among the shapes by, for example, producing shapes that are not centered. In a further example, the shift value for a subband is determined using both of these criteria.

Figure 5:
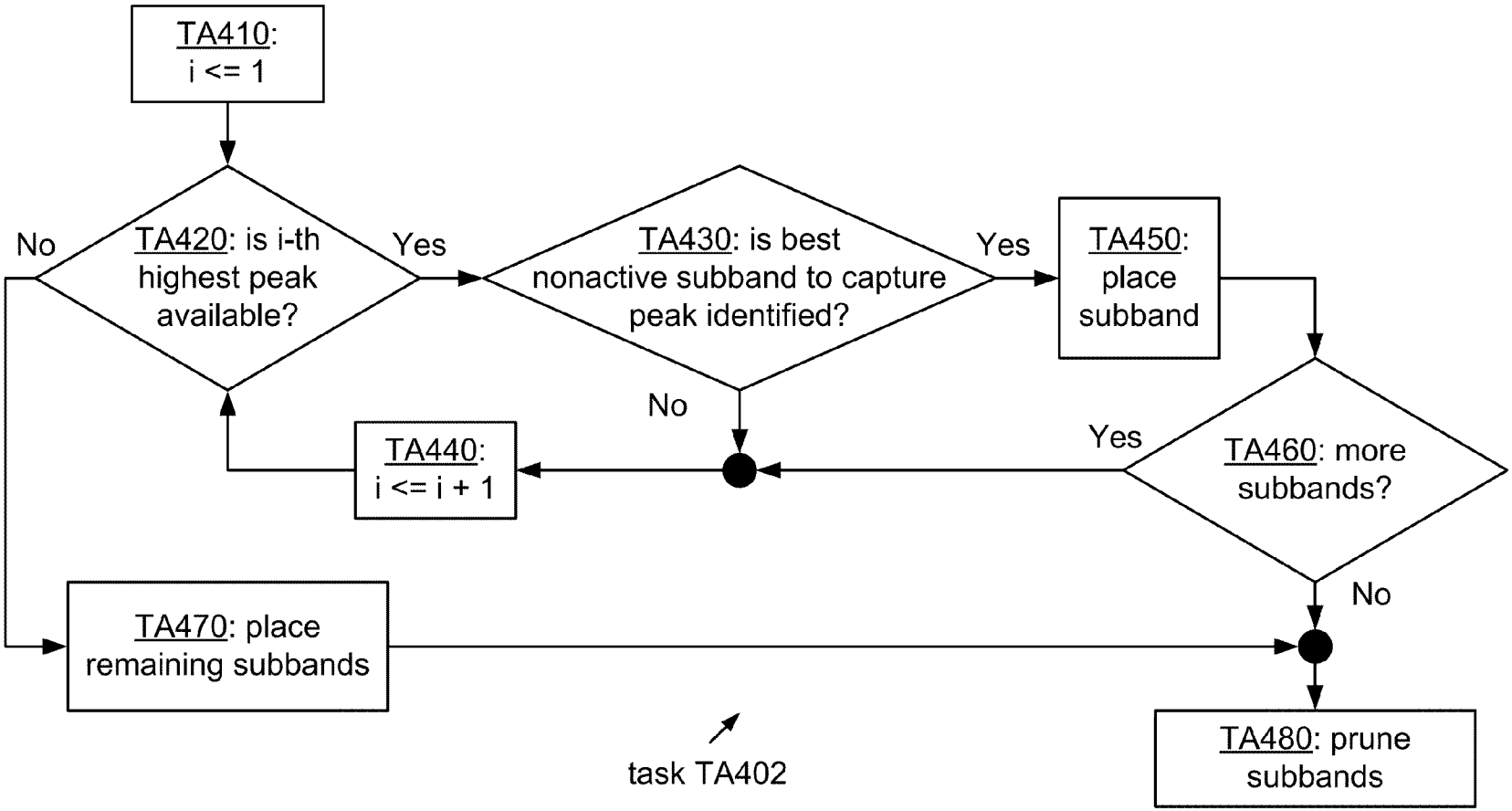
FIG. 5 shows a flowchart of an implementation T402 of task T400.

FIG. 5 shows a flowchart of an implementation TA402 of task TA400 that selects the subband sets according to a relaxed harmonic model. Task TA402 includes tasks TA410, TA420, TA430, TA440, TA450, TA460, and TA470. In this example, task TA402 is configured to execute once for each active candidate pair and to have access to a sorted list of locations of the peaks in the frequency range (e.g., as located by task TA100). It may be desirable for the length of the list of peak locations to be at least as long as the maximum allowable number of subbands for the target frame (e.g., eight, ten, twelve, fourteen, sixteen, or eighteen peaks per frame, for a frame size of 140 or 160 samples).

Loop initialization task TA410 sets the value of a loop counter i to a minimum value (e.g., one). Task TA420 determines whether the i-th highest peak in the list is available (i.e., is not yet in an active subband). If the i-th highest peak is available, task TA430 determines whether any nonactive subband can be placed, according to the locations indicated by the current (F0, d) candidate pair (i.e., F0, F0+d, F0+2d, etc.) as relaxed by the allowable jitter range, to include the location of the peak. In this context, an "active subband" is a subband that has already been placed without overlapping any previously placed subband and has energy greater than (alternatively, not less than) a threshold value T, where T is a function of the maximum energy in the active subbands (e.g., fifteen, twenty, twenty-five, or thirty percent of the energy of the highest-energy active subband placed yet for this frame). A nonactive subband is a subband which is not active (i.e., is not yet placed, is placed but overlaps with another subband, or has insufficient energy). If task TA430 fails to find any nonactive subband that can be placed for the peak, control returns to task TA410 via loop incrementing task TA440 to process the next highest peak in the list (if any).

It may happen that two values of integer j exist for which a subband at location (F0+j*d) may be placed to include the i-th peak (e.g., the peak lies between the two locations), and that neither of these values of j is associated yet with an active subband. For such cases, it may be desirable to implement task TA430 to select among these two subbands. Task TA430 may be implemented, for example, to select the subband that would otherwise have the lower energy. In such case, task TA430 may be implemented to place each of the two subbands subject to the constraints of excluding the peak and not overlapping with any active subband. Within these constraints, task T430 may be implemented to center each subband at the highest possible sample (alternatively, to place each subband to capture the maximum possible energy), to calculate the resulting energy in each of the two subbands, and to select the subband having the lowest energy as the one to be placed (e.g., by task TA450) to include the peak. Such an approach may help to maximize joint energy in the final subband locations.

Figure 2B:
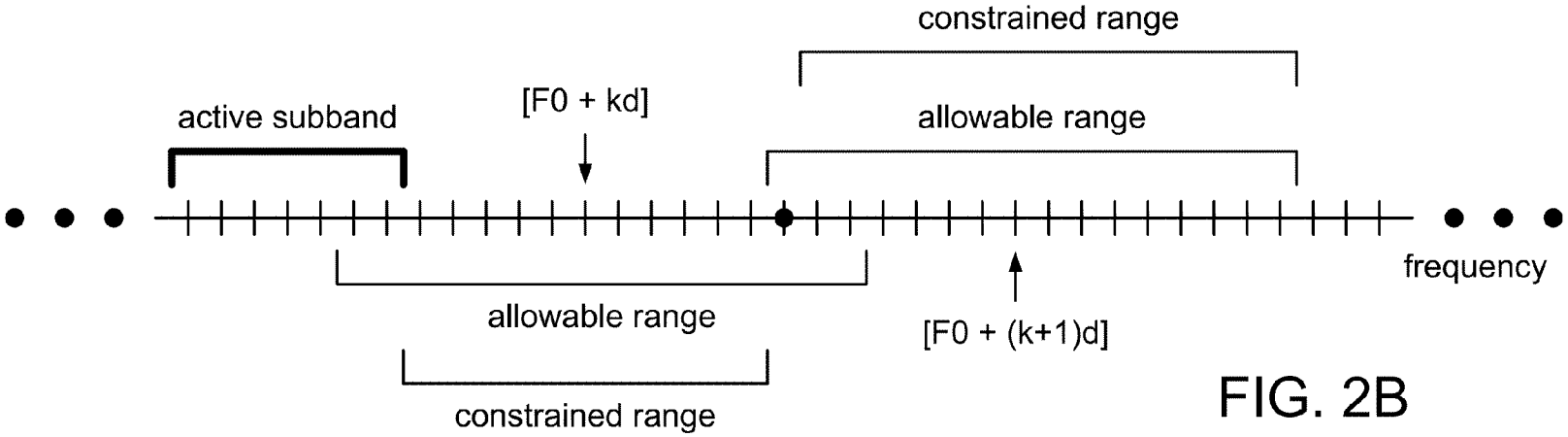
FIG. 2B shows an example of an application of task T430.

FIG. 2B shows an example of an application of task TA430. In this example, the dot in the middle of the frequency axis indicates the location of the i-th peak, the bold bracket indicates the location of an existing active subband, the subband width is seven samples, and the allowable jitter range is (+5, −4). The left and right neighbor locations [F0+kd], [F0+(k+1)d] of the i-th peak, and the range of allowable subband placements for each of these locations, are also indicated. As described above, task TA430 constrains the allowable range of placements for each subband to exclude the peak and not to overlap with any active subband. Within each constrained range as indicated in FIG. 2B, task TA430 places the corresponding subband to be centered at the highest possible sample (or, alternatively, to capture the maximum possible energy) and selects the resulting subband having the lowest energy as the one to be placed to include the i-th peak.

Task TA450 places the subband provided by task TA430 and marks the subband as active or nonactive as appropriate. Task TA450 may be configured to place the subband such that the subband does not overlap with any existing active subband (e.g., by reducing the allowable jitter range for the subband). Task TA450 may also be configured to place the subband such that the i-th peak is centered within the subband (i.e., to the extent permitted by the jitter range and/or the overlap criterion).

Task TA460 returns control to task TA420 via loop incrementing task TA440 if more subbands remain for the current active candidate pair Likewise, task TA430 returns control to task TA420 via loop incrementing task TA440 upon a failure to find a nonactive subband that can be placed for the i-th peak.

If task TA420 fails for any value of i, task TA470 places the remaining subbands for the current active candidate pair. Task TA470 may be configured to place each subband such that the highest sample value is centered within the subband (i.e., to the extent permitted by the jitter range and/or such that the subband does not overlap with any existing active subband). For example, task TA470 may be configured to perform an instance of task TA450 for each of the remaining subbands for the current active candidate pair.

In this example, task TA402 also includes an optional task TA480 that prunes the subbands. Task TA480 may be configured to reject subbands that do not meet an energy threshold (e.g., T) and/or to reject subbands that overlap another subband that has a higher energy.

Figure 6:
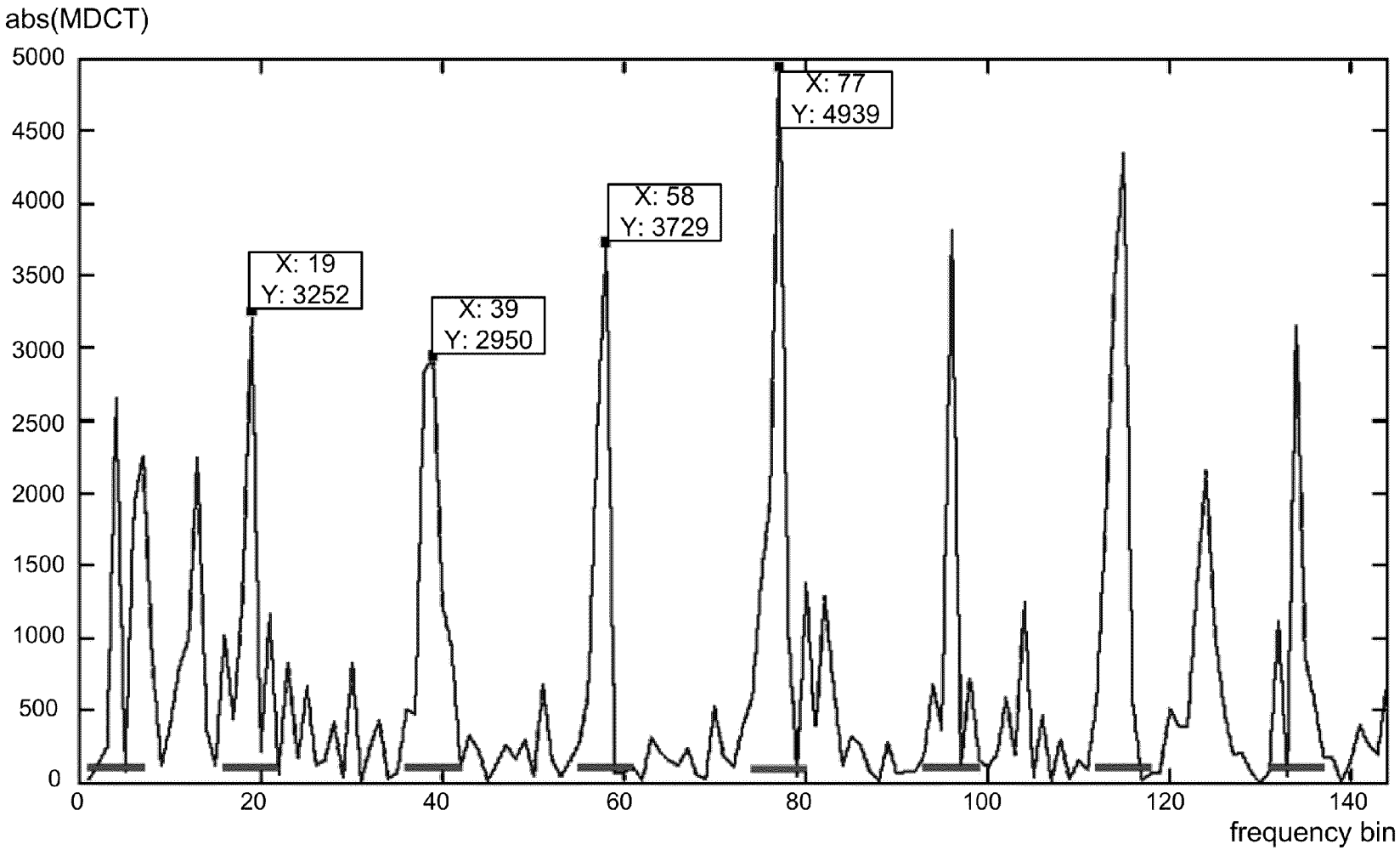
FIG. 6 shows an example of a set of subbands placed according to an implementation of method MA100.

FIG. 6 shows an example of a set of subbands, placed according to an implementation of method MA100 that includes tasks TA402 and TA602, for the 0-3.5 kHz range of a harmonic signal as shown in the MDCT domain. In this example, the y axis indicates absolute MDCT value, and the subbands are indicated by the blocks near the x or frequency bin axis.

Task TA700 may be implemented to pack the selected jitter values into the encoded signal (e.g., for transmission to the decoder). It is also possible, however, to apply a relaxed harmonic model in task TA400 (e.g., as task TA402) but to implement the corresponding instance of task TA700 to omit the jitter values from the encoded signal. Even for a low-bit-rate case in which no bits are available to transmit the jitter, for example, it may still be desirable to apply a relaxed model at the encoder, as it may be expected that the perceptual benefit gained by encoding more of the signal energy will outweigh the perceptual error caused by the uncorrected jitter. One example of such an application is for low-bit-rate coding of music signals.

In some applications, it may be sufficient for the encoded signal to include only the subbands selected by a harmonic model, such that the encoder discards signal energy that is outside of the modeled subbands. In other cases, it may be desirable for the encoded signal also to include such signal information that is not captured by the harmonic model.

In one approach, a representation of the uncoded information (also called a residual signal) is calculated at the encoder by subtracting the reconstructed harmonic-model subbands from the original input spectrum. A residual calculated in such manner will typically have the same length as the input signal.

For a case in which a relaxed harmonic model is used to encode the signal, the jitter values that were used to shift the locations of the subbands may or may not be available at the decoder. If the jitter values are available at the decoder, then the decoded subbands may be placed in the same locations at the decoder as at the encoder. If the jitter values are not available at the decoder, the selected subbands may be placed at the decoder according to a uniform spacing as indicated by the selected (F0, d) pair. For a case in which the residual signal was calculated by subtracting the reconstructed signal from the original signal, however, the unjittered subbands will no longer be phase-aligned to the residual signal, and adding the reconstructed signal to such a residual signal may result in destructive interference.

Figure 19:
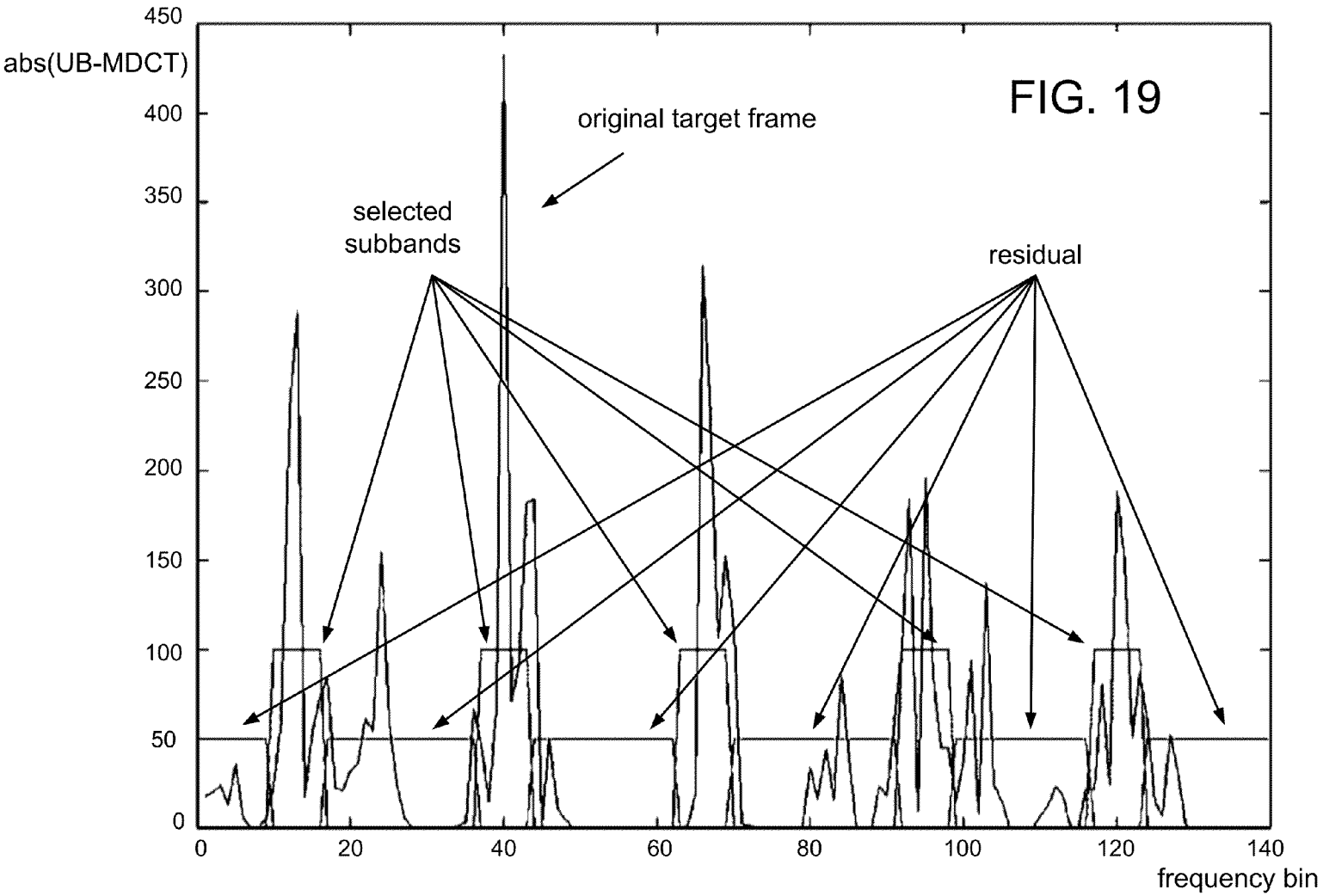
FIG. 19 shows an example of an application of method MA100.

An alternative approach is to calculate the residual signal as a concatenation of the regions of the input signal spectrum that were not captured by the harmonic model (e.g., those bins that were not included in the selected subbands). Such an approach may be desirable especially for coding applications in which the jitter parameter values are not transmitted to the decoder. A residual calculated in such manner has a length which is less than that of the input signal and which may vary from frame to frame (e.g., depending on the number of subbands in the frame). FIG. 19 shows an example of an application of method MA100 to encode the MDCT coefficients corresponding to the 3.5-7 kHz band of an audio signal frame in which the regions of such a residual are labeled. As described herein, it may be desirable to use a pulse-coding scheme (e.g., factorial pulse coding) to encode such a residual.

For a case in which the jitter parameter values are not available at the decoder, the residual signal can be inserted between the decoded subbands using one of several different methods. One such method of decoding is to zero out each jitter range in the residual signal before adding it to the unjittered reconstructed signal. For the jitter range of (+4, −3) as mentioned above, for example, such a method would include zeroing samples of the residual signal from four bins to the right of to three bins to the left of each of the subbands indicated by the (F0, d) pair. Although such an approach may remove interference between the residual and the unjittered subbands, however, it also causes a loss of information that may be significant.

Figure 7:
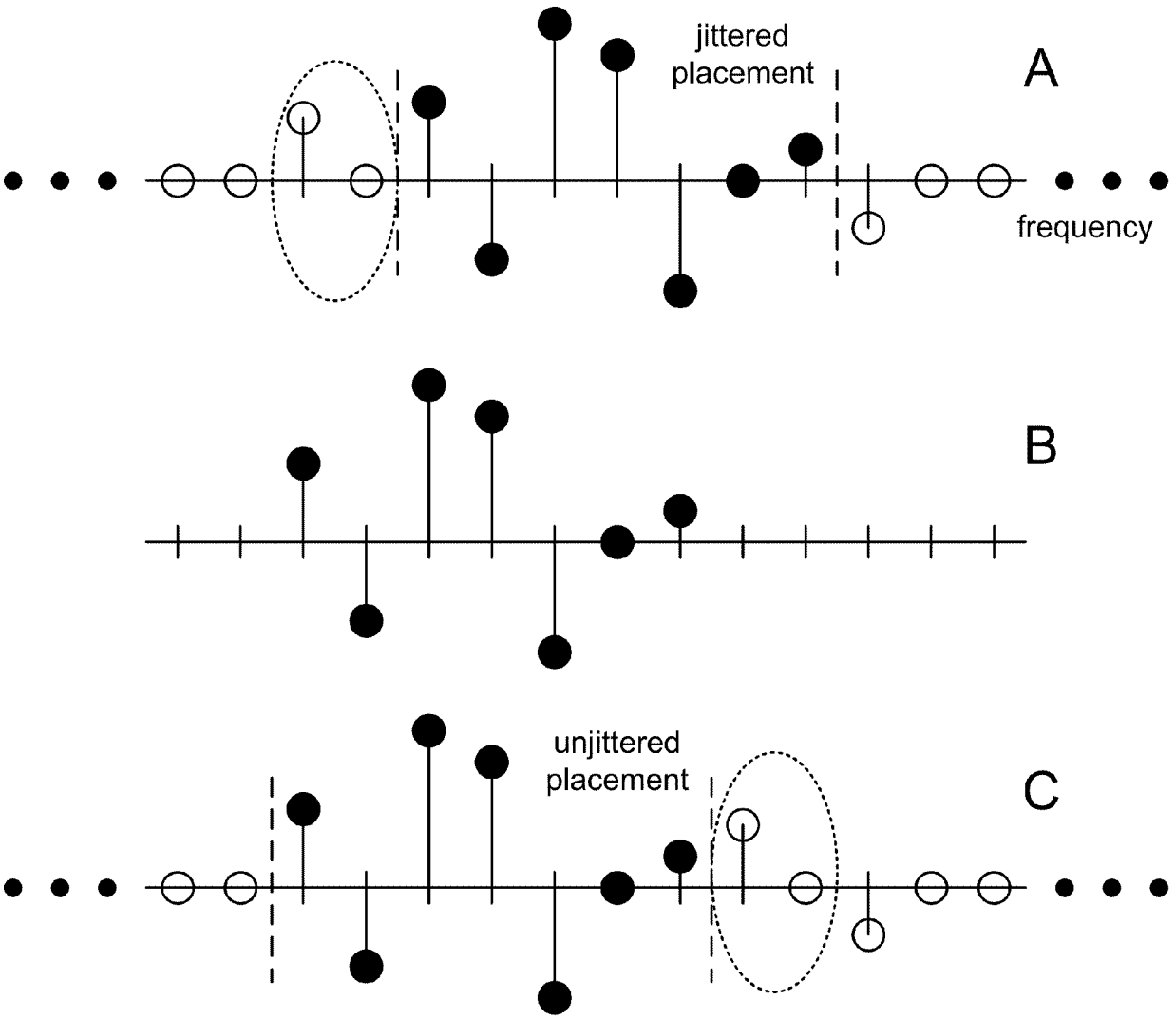
FIG. 7 shows one example of an approach to compensating for a lack of jitter information.

Another method of decoding is to insert the residual to fill up the bins not occupied by the unjittered reconstructed signal (e.g., the bins before, after, and between the unjittered reconstructed subbands). Such an approach effectively moves energy of the residual to accommodate the unjittered placements of the reconstructed subbands. FIG. 7 shows one example of such an approach, with the three amplitude-vs.-frequency plots A-C all being aligned vertically to the same horizontal frequency-bin scale. Plot A shows a part of the signal spectrum that includes the original, jittered placement of a selected subband (filled dots within the dashed lines) and some of the surrounding residual (open dots). In plot B, which shows the placement of the unjittered subband, it may be seen that the first two bins of the subband now overlap a series of samples of the original residual that contains energy (the samples circled in plot A). Plot C shows an example of using the concatenated residual to fill the unoccupied bins in order of increasing frequency, which places this series of samples of the residual on the other side of the unjittered subband.

Figure 8:
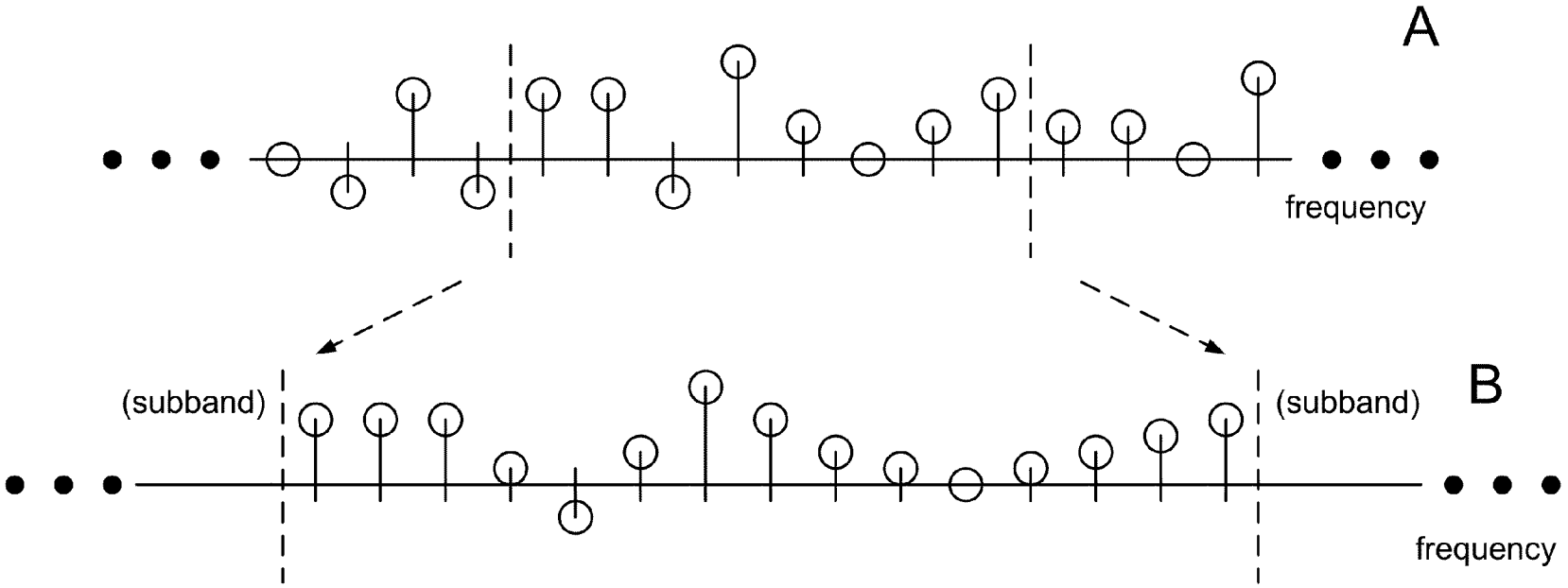
FIG. 8 shows an example of expanding a region of a residual signal.

A further method of decoding is to insert the residual in such a way that continuity of the MDCT spectrum is maintained at the boundaries between the unjittered subbands and the residual signal. For example, such a method may include compressing a region of the residual that is between two unjittered subbands (or is before the first or after the last subband) in order to avoid an overlap at either or both ends. Such compression may be performed, for example, by frequency-warping the region to occupy the area between the subbands (or between the subband and the range boundary). Similarly, such a method may include expanding a region of the residual that is between two unjittered subbands (or is before the first or after the last subband) in order to fill a gap at either or both ends. FIG. 8 shows such an example in which the portion of the residual between the dashed lines in amplitude-vs.-frequency plot A is expanded (e.g., linearly interpolated) to fill a gap between unjittered subbands as shown in amplitude-vs.-frequency plot B.

Figure 9:
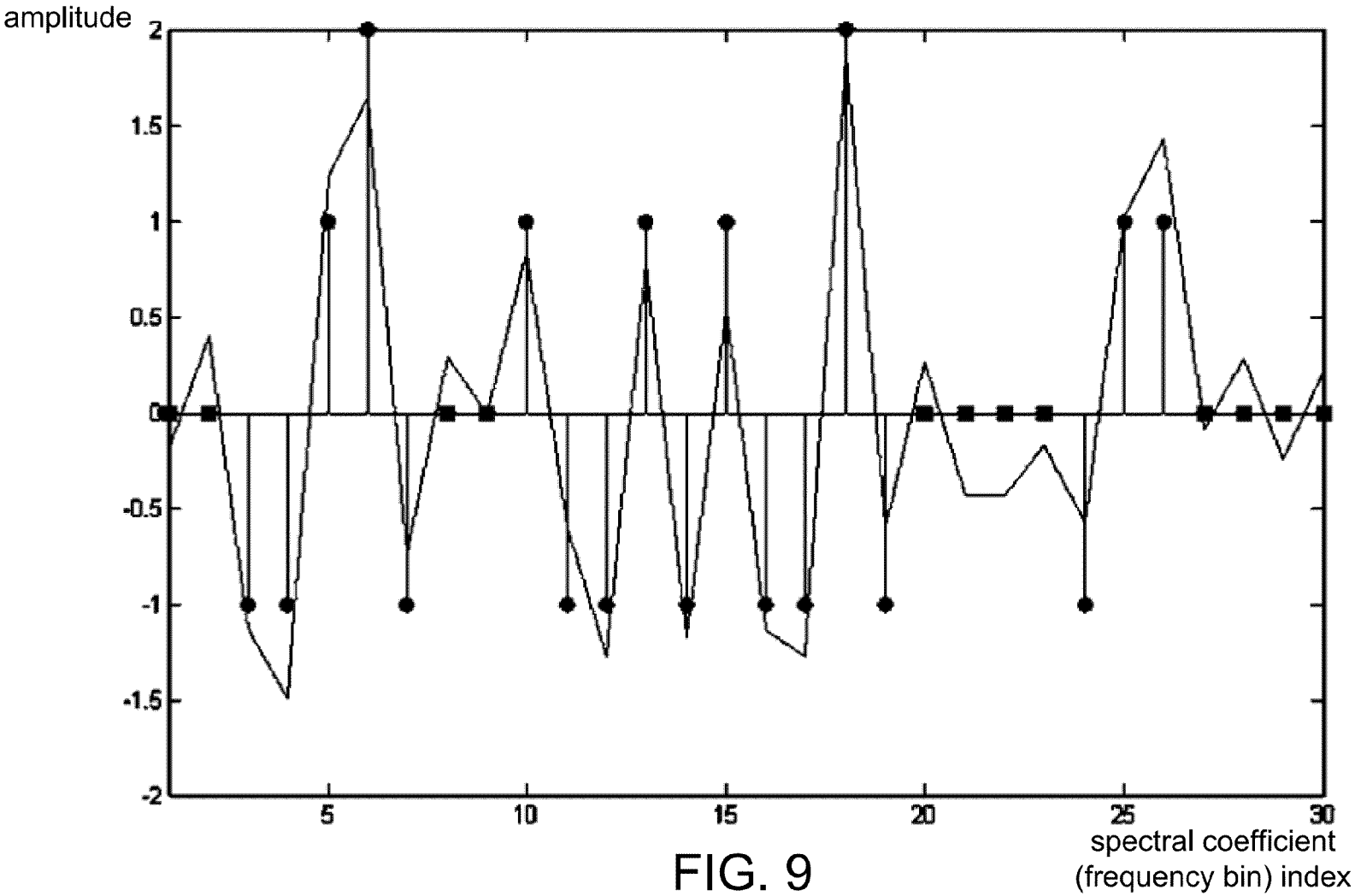
FIG. 9 shows an example of encoding a portion of a residual signal as a number of unit pulses.

It may be desirable to use a pulse coding scheme to code the residual signal, which encodes a vector by matching it to a pattern of unit pulses and using an index which identifies that pattern to represent the vector. Such a scheme may be configured, for example, to encode the number, positions, and signs of unit pulses in the residual signal. FIG. 9 shows an example of such a method in which a portion of a residual signal is encoded as a number of unit pulses. In this example, a thirty-dimensional vector, whose value at each dimension is indicated by the solid line, is represented by the pattern of pulses (0, 0, −1, −1, +1, +2, −1, 0, 0, +1, −1, −1, +1, −1, +1, −1, −1, +2, −1, 0, 0, 0, 0, −1, +1, +1, 0, 0, 0, 0), as indicated by the dots (at pulse locations) and squares (at zero-value locations).

The positions and signs of a particular number of unit pulses may be represented as a codebook index. A pattern of pulses as shown in FIG. 9, for example, can typically be represented by a codebook index whose length is much less than thirty bits. Examples of pulse coding schemes include factorial-pulse-coding schemes and combinatorial-pulse-coding schemes.

It may be desirable to configure an audio codec to code different frequency bands of the same signal separately. For example, it may be desirable to configure such a codec to produce a first encoded signal that encodes a lowband portion of an audio signal and a second encoded signal that encodes a highband portion of the same audio signal. Applications in which such split-band coding may be desirable include wideband encoding systems that must remain compatible with narrowband decoding systems. Such applications also include generalized audio coding schemes that achieve efficient coding of a range of different types of audio input signals (e.g., both speech and music) by supporting the use of different coding schemes for different frequency bands.

For a case in which different frequency bands of a signal are encoded separately, it may be possible in some cases to increase coding efficiency in one band by using encoded (e.g., quantized) information from another band, as this encoded information will already be known at the decoder. For example, the principles of applying a harmonic model as described herein (e.g., a relaxed harmonic model) may be extended to use information from a decoded representation of the transform coefficients of a first band of an audio signal frame (also called the "reference" signal) to encode the transform coefficients of a second band of the same audio signal frame (also called the "target" signal). For such a case in which the harmonic model is relevant, coding efficiency may be increased because the decoded representation of the first band is already available at the decoder.

Such an extended method may include determining subbands of the second band that are harmonically related to the coded first band. In low-bit-rate coding algorithms for audio signals (for example, complex music signals), it may be desirable to split a frame of the signal into multiple bands (e.g., a lowband and a highband) and to exploit a correlation between these bands to efficiently code the transform domain representation of the bands.

In a particular example of such extension, the MDCT coefficients corresponding to the 3.5-7 kHz band of an audio signal frame (henceforth referred to as upperband MDCT or UB-MDCT) are encoded based on the quantized lowband MDCT spectrum (0-4 kHz) of the frame. It is explicitly noted that in other examples of such extension, the two frequency ranges need not overlap and may even be separated (e.g., coding a 7-14 kHz band of a frame based on information from a decoded representation of the 0-4 kHz band). Since the coded lowband MDCTs are used as a reference for coding the UB-MDCTs, many parameters of the highband coding model can be derived at the decoder without explicitly requiring their transmission.

Figure 10B:
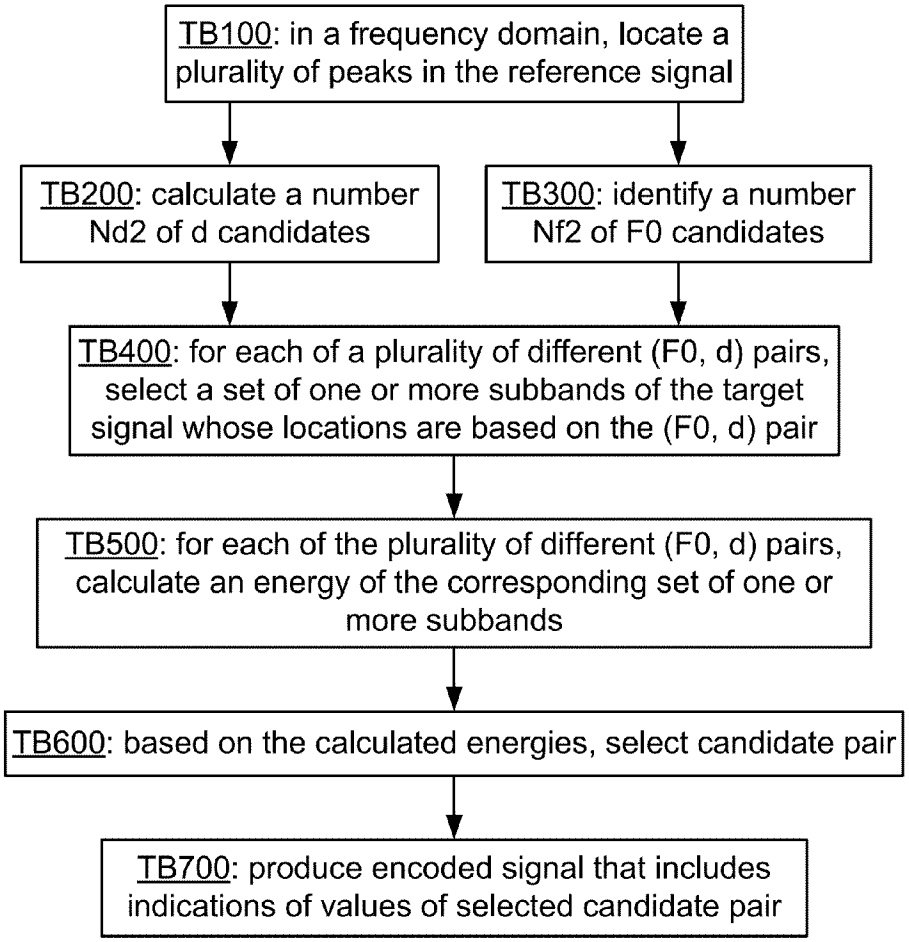
FIG. 10B shows a flowchart of an implementation MB110 of method MB100.
Figure 10A:
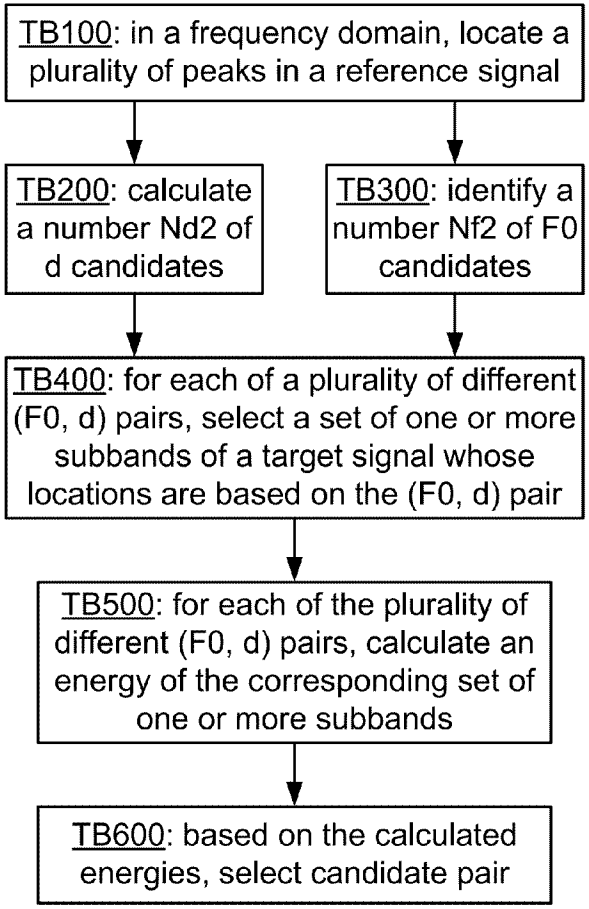
FIG. 10A shows a flowchart for a method MB100 of processing an audio signal according to a general configuration.

FIG. 10A shows a flowchart for a method MB100 of audio signal processing according to a general configuration that includes tasks TB100, TB200, TB300, TB400, TB500, TB600, and TB700. Task TB100 locates a plurality of peaks in a reference audio signal (e.g., a dequantized representation of a first frequency range of an audio-frequency signal). Task TB100 may be implemented as an instance of task TA100 as described herein. For a case in which the reference audio signal was encoded using an implementation of method MA100, it may be desirable to configure tasks TA100 and TB100 to use the same value of $d_{min}$, although it is also possible to configure the two tasks to use different values of $d_{min}$. (It is important to note, however, that method MB100 is generally applicable regardless of the particular coding scheme that was used to produce the decoded reference audio signal.)

Based on the frequency-domain locations of at least some (i.e., at least three) of the peaks located by task TB100, task TB200 calculates a number Nd2 of harmonic spacing candidates in the reference audio signal. Examples of values for Nd2 include three, four, and five. Task TB200 may be configured to compute these spacing candidates as the distances (e.g., in terms of number of frequency bins) between adjacent ones of the (Nd2+1) largest peaks located by task TB100.

Based on the frequency-domain locations of at least some (i.e., at least two) of the peaks located by task TB100, task TB300 identifies a number Nf2 of F0 candidates in the reference audio signal. Examples of values for Nf2 include three, four, and five. Task TB300 may be configured to identify these candidates as the locations of the Nf2 highest peaks in the reference audio signal. Alternatively, task TB300 may be configured to identify these candidates as the locations of the Nf2 highest peaks in a low-frequency portion (e.g., the lower 30, 35, 40, 45, or 50 percent) of the reference frequency range. In one such example, task TB300 identifies the number Nf2 of F0 candidates from among the locations of peaks located by task TB100 in the range of from 0 to 1250 Hz. In another such example, task TB300 identifies the number Nf2 of F0 candidates from among the locations of peaks located by task TB100 in the range of from 0 to 1600 Hz.

It is expressly noted that the scope of described implementations of method MB100 includes the case in which only one harmonic spacing candidate is calculated (e.g., as the distance between the largest two peaks, or the distance between the largest two peaks in a specified frequency range) and the separate case in which only one F0 candidate is identified (e.g., as the location of the highest peak, or the location of the highest peak in a specified frequency range).

For each of a plurality of active pairs of the F0 and d candidates, task TB400 selects a set of at least one subband of a target audio signal (e.g., a representation of a second frequency range of the audio-frequency signal), wherein a location in the frequency domain of each subband of the set is based on the (F0, d) pair. As opposed to task TA400, however, in this case the subbands are placed relative to the locations F0m, F0m+d, F0m+2d, etc., where the value of F0m is calculated by mapping F0 into the frequency range of the target audio signal. Such a mapping may be performed according to an expression such as F0m=F0+Ld, where L is the smallest integer such that F0 m is within the frequency range of the target audio signal. In such case, the decoder may calculate the same value of L without further information from the encoder, as the frequency range of the target audio signal and the values of F0 and d are already known at the decoder.

Task TB400 may be configured to select each set to include all of the subbands indicated by the corresponding (F0, d) pair that lie within the input range. Alternatively, task TB400 may be configured to select fewer than all of these subbands for at least one of the sets. Task TB400 may be configured, for example, to select not more than a maximum number of subbands for the set. Alternatively or additionally, task TB400 may be configured to select only subbands that lie within a particular range. For example, it may be desirable to configure task TB400 to select not more than a particular number of one or more (e.g., four, five, or six) of the lowest-frequency subbands in the input range and/or only subbands whose locations are not above a particular frequency within the input range (e.g., 5000, 5500, or 6000 Hz).

In one example, task TB400 is configured to select the subbands of each set such that the first subband is centered at the corresponding F0m location, with the center of each subsequent subband being separated from the center of the previous subband by a distance equal to the corresponding value of d.

All of the different pairs of values of F0 and d may be considered to be active, such that task TB400 is configured to select a corresponding set of one or more subbands for every possible (F0, d) pair. For a case in which Nf2 and Nd2 are both equal to four, for example, task TB400 may be configured to consider each of the sixteen possible pairs. Alternatively, task TB400 may be configured to impose a criterion for activity that some of the possible (F0, d) pairs may fail to meet. In such case, for example, task TB400 may be configured to ignore pairs that would produce more than a maximum allowable number of subbands (e.g., combinations of low values of F0 and d) and/or pairs that would produce less than a minimum desired number of subbands (e.g., combinations of high values of F0 and d).

For each of a plurality of pairs of the F0 and d candidates, task TB500 calculates at least one energy value from the corresponding set of one or more subbands of the target audio signal. In one such example, task TB500 calculates an energy value from each set of one or more subbands as the total energy of the set of subbands (e.g., as a sum of the squared magnitudes of the frequency-domain sample values in the subbands). Alternatively or additionally, task TB500 may be configured to calculate energy values from each set of subbands as the energies of each individual subband and/or to calculate an energy value from each set of subbands as an average energy per subband (e.g., total energy normalized over the number of subbands) for the set of subbands. Task TB500 may be configured to execute for each of the same plurality of pairs as task TB400 or for fewer than this plurality. For a case in which task TB400 is configured to select a set of subbands for each possible (F0, d) pair, for example, task TB500 may be configured to calculate energy values only for pairs that satisfy a specified criterion for activity (e.g., to ignore pairs that would produce too many subbands and/or pairs that would produce too few subbands, as described above). In another example, task TB400 is configured to ignore pairs that would produce too many subbands and task TB500 is configured to also ignore pairs that would produce too few subbands.

Although FIG. 10A shows execution of tasks TB400 and TB500 in series, it will be understood that task TB500 may also be implemented to begin to calculate energies for sets of subbands before task TB400 has completed. For example, task TB500 may be implemented to begin to calculate (or even to finish calculating) an energy value from a set of subbands before task TB400 begins to select the next set of subbands. In one such example, tasks TB400 and TB500 are configured to alternate for each of the plurality of active pairs of the F0 and d candidates. Likewise, task TB400 may also be implemented to begin execution before task TB200 and TB300 have completed.

Based on calculated energy values from at least some of the sets of at least one subband, task TB600 selects a candidate pair from among the (F0, d) candidate pairs. In one example, task TB600 selects the pair corresponding to the set of subbands having the highest total energy. In another example, task TB600 selects the candidate pair corresponding to the set of subbands having the highest average energy per subband. In a further example, task TB600 is implemented as an instance of task TA602 (e.g., as shown in FIG. 1B).

FIG. 10B shows a flowchart of an implementation MB110 of method MB100 that includes a task TB700. Task TB700 produces an encoded signal that includes indications of the values of the selected candidate pair. Task TB700 may be configured to encode the selected value of F0, or to encode an offset of the selected value of F0 from a minimum (or maximum) location. Similarly, task TB700 may be configured to encode the selected value of d, or to encode an offset of the selected value of d from a minimum or maximum distance. In a particular example, task TB700 uses six bits to encode the selected F0 value and six bits to encode the selected d value. In further examples, task TB700 may be implemented to encode the current value of F0 and/or d differentially (e.g., as an offset relative to a previous value of the parameter).

It may be desirable to implement task TB700 to use a VQ coding scheme (e.g., GSVQ) to encode the selected set of subbands as vectors. It may be desirable to use a GSVQ scheme that includes predictive gain coding such that the gain factors for each set of subbands are encoded independently from one another and differentially with respect to the corresponding gain factor of the previous frame. In a particular example, method MB110 is arranged to encode regions of significant energy in a frequency range of an UB-MDCT spectrum.

Because the reference audio signal is available at the decoder, tasks TB100, TB200, and TB300 may also be performed at the decoder to obtain the same number (or "codebook") Nf2 of F0 candidates and the same number ("codebook") Nd2 of d candidates from the same reference audio signal. The values in each codebook may be sorted, for example, in order of increasing value. Consequently, it is sufficient for the encoder to transmit an index into each of these ordered pluralities, instead of encoding the actual values of the selected (F0, d) pair. For a particular example in which Nf2 and Nd2 are both equal to four, task TB700 may be implemented to use a two-bit codebook index to indicate the selected d value and another two-bit codebook index to indicate the selected F0 value.

A method of decoding an encoded target audio signal produced by task TB700 may also include selecting the values of F0 and d indicated by the indices, dequantizing the selected set of subbands, calculating the mapping value m, and constructing a decoded target audio signal by placing (e.g., centering) each subband p at the frequency-domain location F0m+pd, where $0<=p<P$ and P is the number of subbands in the selected set. Unoccupied bins of the decoded target signal may be assigned zero values or, alternatively, values of a decoded residual as described herein.

Like task TA400, task TB400 may be implemented as iterated instances of task TA402 as described above, with the exception that each value of F0 is first mapped to F0m as described above. In this case, task TA402 is configured to execute once for each candidate pair to be evaluated and to have access to a list of locations of the peaks in the target signal, where the list is sorted in decreasing order of sample value. To produce such a list, method MB100 may also include a peak-picking task analogous to task TB100 (e.g., another instance of task TB100) that is configured to operate over the target signal rather than over the reference signal.

Figure 11:
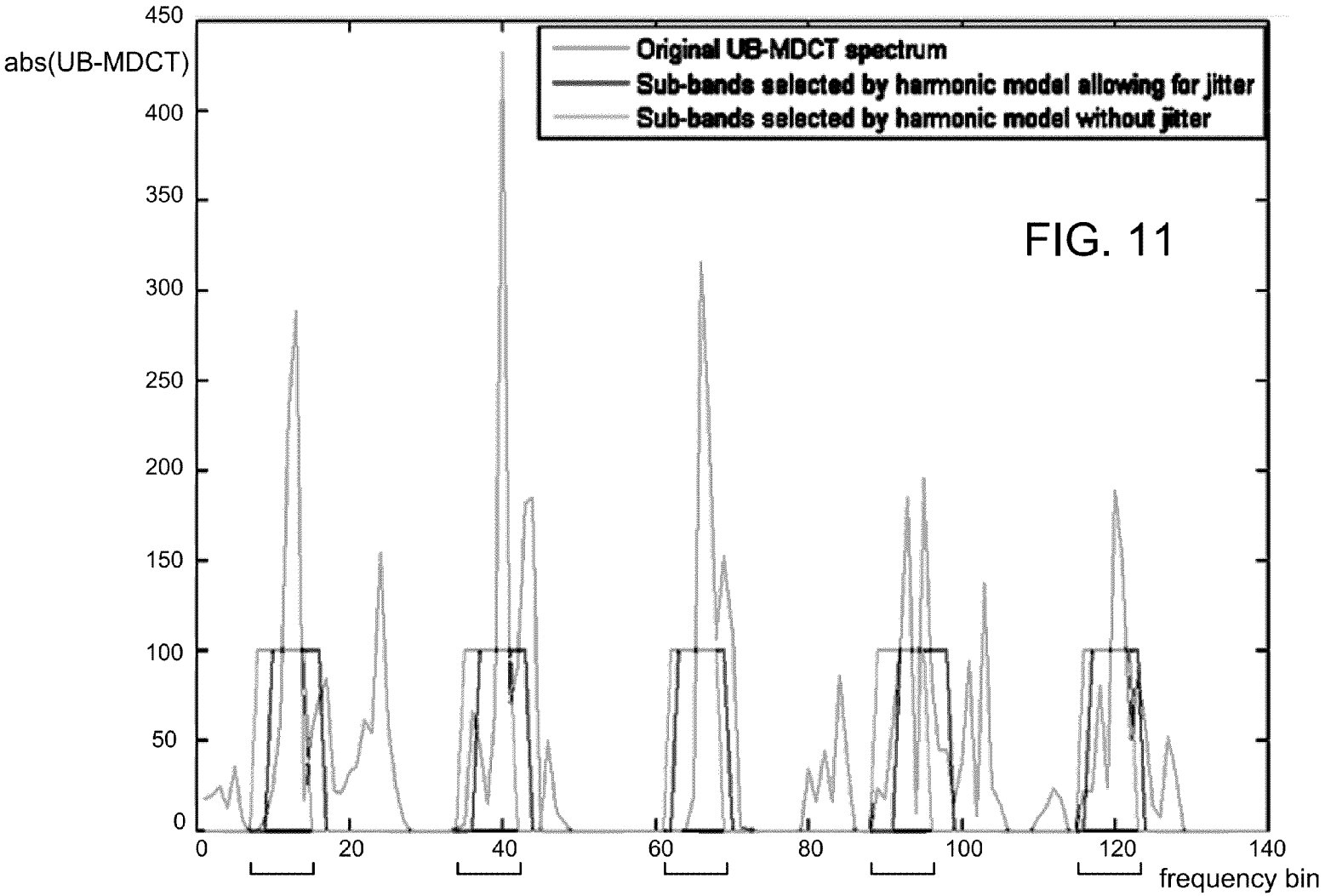
FIG. 11 shows a plot of magnitude vs. frequency for an example in which the target audio signal is a UB-MDCT signal.

FIG. 11 shows a plot of magnitude vs. frequency for an example in which the target audio signal is a UB-MDCT signal of 140 transform coefficients that represent the audio-frequency spectrum of 3.5-7 kHz. This figure shows the target audio signal (gray line), a set of five uniformly spaced subbands selected according to an (F0, d) candidate pair (indicated by the blocks drawn in gray and by the brackets), and a set of five jittered subbands selected according to the (F0, d) pair and a peak-centering criterion (indicated by the blocks drawn in black). As shown in this example, the UB-MDCT spectrum may be calculated from a highband signal that has been converted to a lower sampling rate or otherwise shifted for coding purposes to begin at frequency bin zero or one. In such case, each mapping of F0m also includes a shift to indicate the appropriate frequency within the shifted spectrum. In a particular example, the first frequency bin of the UB-MDCT spectrum of the target audio signal corresponds to bin 140 of the LB-MDCT spectrum of the reference audio signal (e.g., representing acoustic content at 3.5 kHz), such that task TA400 may be implemented to map each F0 to a corresponding F0m according to an expression such as $F0m=F0+Ld-140$.

For a case in which the reference audio signal was encoded using a relaxed harmonic model as described herein, the same jitter bounds (e.g., up to four bins right and up to three bins left) may be used for encoding the target signal using a relaxed harmonic model, or a different jitter bound may be used on one or both sides. For each subband, it may be desirable to select the jitter value that centers the peak within the subband if possible or, if no such jitter value is available, the jitter value that partially centers the peak or, if no such jitter value is available, the jitter value that maximizes the energy captured by the subband.

In one example, task TB400 is configured to select the (F0, d) pair that compacts the maximum energy per subband in the target signal (e.g., the UB-MDCT spectrum). Energy compaction may also be used as a measure to decide between two or more jitter candidates which center or partially center (e.g., as described above with reference to task TA430).

The jitter parameter values (e.g., one for each subband) may be transmitted to the decoder. If the jitter values are not transmitted to the decoder, then an error may arise in the frequency locations of the harmonic model subbands. For target signals that represent a highband audio-frequency range (e.g., the 3.5-7 kHz range), however, this error is typically not perceivable, such that it may be desirable to encode the subbands according to the selected jitter values but not to send those jitter values to the decoder, and the subbands may be uniformly spaced (e.g., based only on the selected (F0, d) pair) at the decoder. For very low bit-rate coding of music signals (e.g., about twenty kilobits per second), for example, it may be desirable not to transmit the jitter parameter values and to allow an error in the locations of the subbands at the decoder.

After the set of selected subbands has been identified, a residual signal may be calculated at the encoder by subtracting the reconstructed target signal from the original target signal spectrum (e.g., as the difference between the original target signal spectrum and the reconstructed harmonic-model subbands). Alternatively, the residual signal may be calculated as a concatenation of the regions of the target signal spectrum that were not captured by the harmonic modeling (e.g., those bins that were not included in the selected subbands). For a case in which the target audio signal is a UB-MDCT spectrum and the reference audio signal is a reconstructed LB-MDCT spectrum, it may be desirable to obtain the residual by concatenating the uncaptured regions, especially for a case in which jitter values used to encode the target audio signal will not available at the decoder. The selected subbands may be coded using a vector quantization scheme (e.g., a GSVQ scheme), and the residual signal may be coded using a factorial pulse coding scheme or a combinatorial pulse coding scheme.

If the jitter parameter values are available at the decoder, then the residual signal may be put back into the same bins at the decoder as at the encoder. If the jitter parameter values are not available at the decoder (e.g., for low bit-rate coding of music signals), the selected subbands may be placed at the decoder according to a uniform spacing based on the selected (F0, d) pair as described above. In this case, the residual signal can be inserted between the selected subbands using one of several different methods as described above (e.g., zeroing out each jitter range in the residual before adding it to the jitterless reconstructed signal, using the residual to fill unoccupied bins while moving residual energy that would overlap a selected subband, or frequency-warping the residual).

Figure 12A:
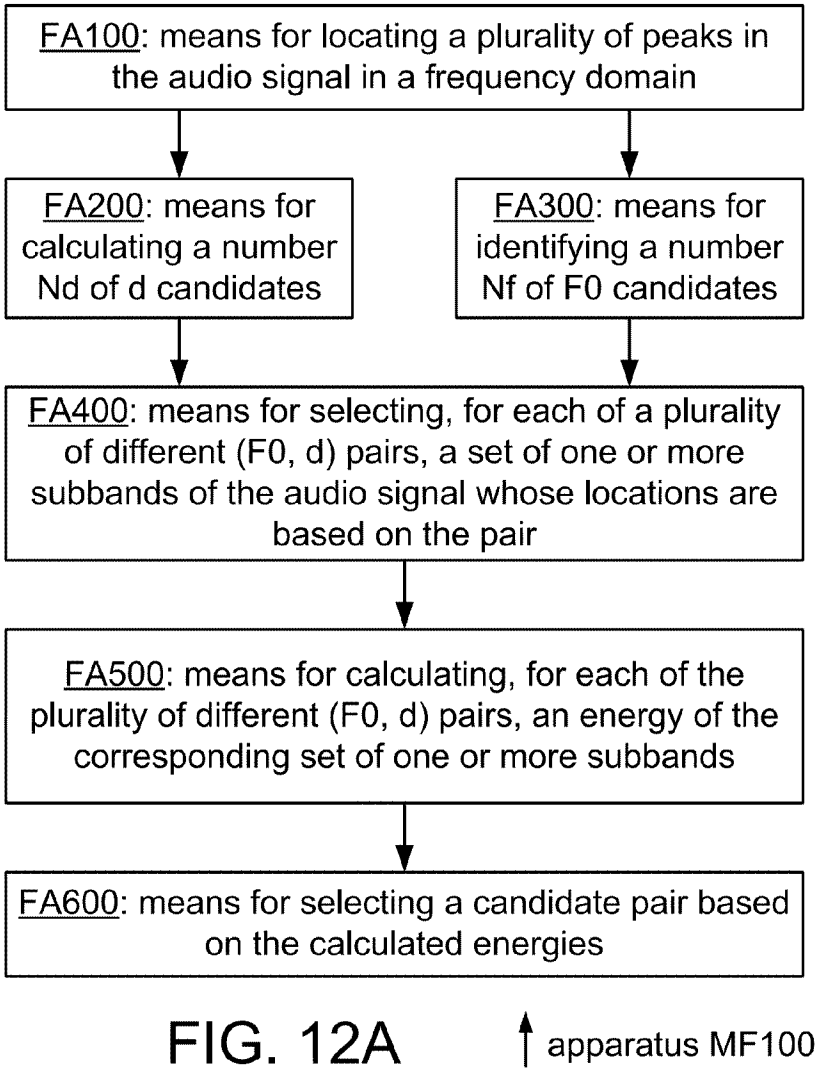
FIG. 12A shows a block diagram of an apparatus MF100 for processing an audio signal according to a general configuration.

FIG. 12A shows a block diagram of an apparatus for audio signal processing MF100 according to a general configuration. Apparatus MF100 includes means FA100 for locating a plurality of peaks in the audio signal in a frequency domain (e.g., as described herein with reference to task TA100). Apparatus MF100 also includes means FA200 for calculating a number Nd of harmonic spacing (d) candidates (e.g., as described herein with reference to task TA200). Apparatus MF100 also includes means FA300 for identifying a number Nf of fundamental frequency (F0) candidates (e.g., as described herein with reference to task TA300). Apparatus MF100 also includes means FA400 for selecting, for each of a plurality of different (F0, d) pairs, a set of subbands of the audio signal whose locations are based on the pair (e.g., as described herein with reference to task TA400). Apparatus MF100 also includes means FA500 for calculating, for each of the plurality of different (F0, d) pairs, an energy of the corresponding set of subbands (e.g., as described herein with reference to task TA500). Apparatus MF100 also includes means FA600 for selecting a candidate pair based on the calculated energies (e.g., as described herein with reference to task TA600). FIG. 13A shows a block diagram of an implementation MF110 of apparatus MF100 that includes means FA700 for producing an encoded signal that includes indications of the values of the selected candidate pair (e.g., as described herein with reference to task TA700).

Figure 12B:
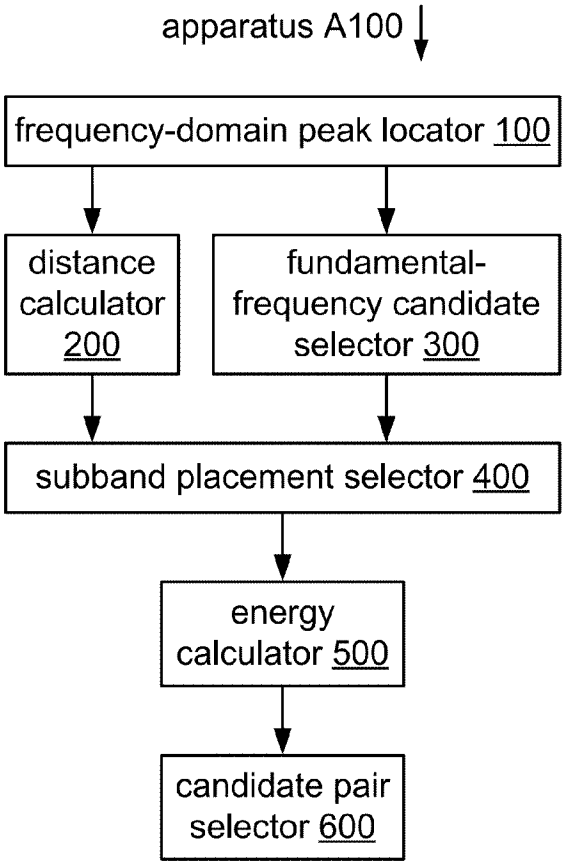
FIG. 12B shows a block diagram of an apparatus A100 for processing an audio signal according to a general configuration.

FIG. 12B shows a block diagram of an apparatus for audio signal processing A100 according to another general configuration. Apparatus A100 includes a frequency-domain peak locator 100 configured to locate a plurality of peaks in the audio signal in a frequency domain (e.g., as described herein with reference to task TA100). Apparatus A100 also includes a distance calculator 200 configured to calculate a number Nd of harmonic spacing (d) candidates (e.g., as described herein with reference to task TA200). Apparatus A100 also includes a fundamental-frequency candidate selector 300 configured to identify a number Nf of fundamental frequency (F0) candidates (e.g., as described herein with reference to task TA300). Apparatus A100 also includes a subband placement selector 400 configured to select, for each of a plurality of different (F0, d) pairs, a set of subbands of the audio signal whose locations are based on the pair (e.g., as described herein with reference to task TA400). Apparatus A100 also includes an energy calculator 500 configured to calculate, for each of the plurality of different (F0, d) pairs, an energy of the corresponding set of subbands (e.g., as described herein with reference to task TA500). Apparatus A100 also includes a candidate pair selector 600 configured to select a candidate pair based on the calculated energies (e.g., as described herein with reference to task TA600). It is expressly noted that apparatus A100 may also be implemented such that its various elements are configured to perform corresponding tasks of method MB100 as described herein.

Figure 13B:
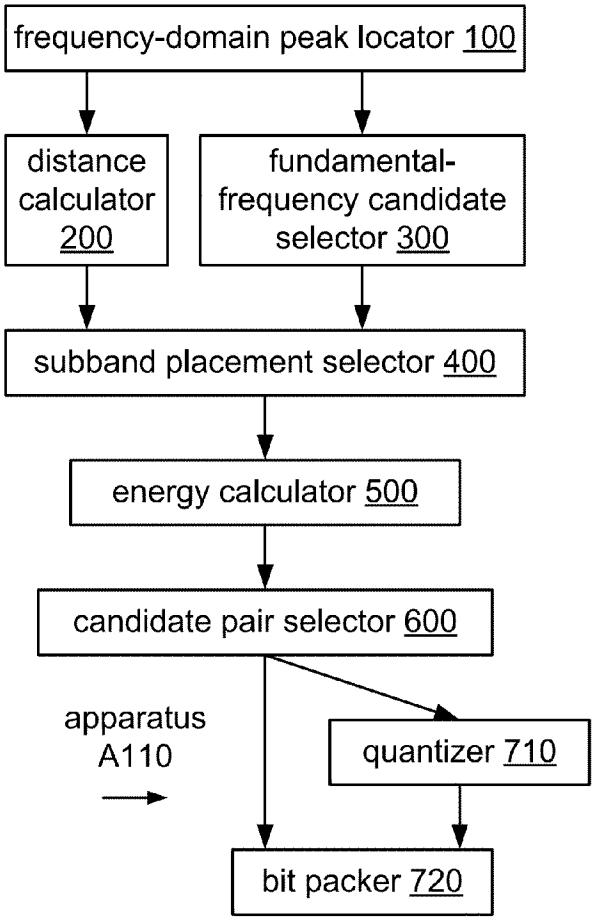
FIG. 13B shows a block diagram of an implementation A110 of apparatus A100.
Figure 13A:
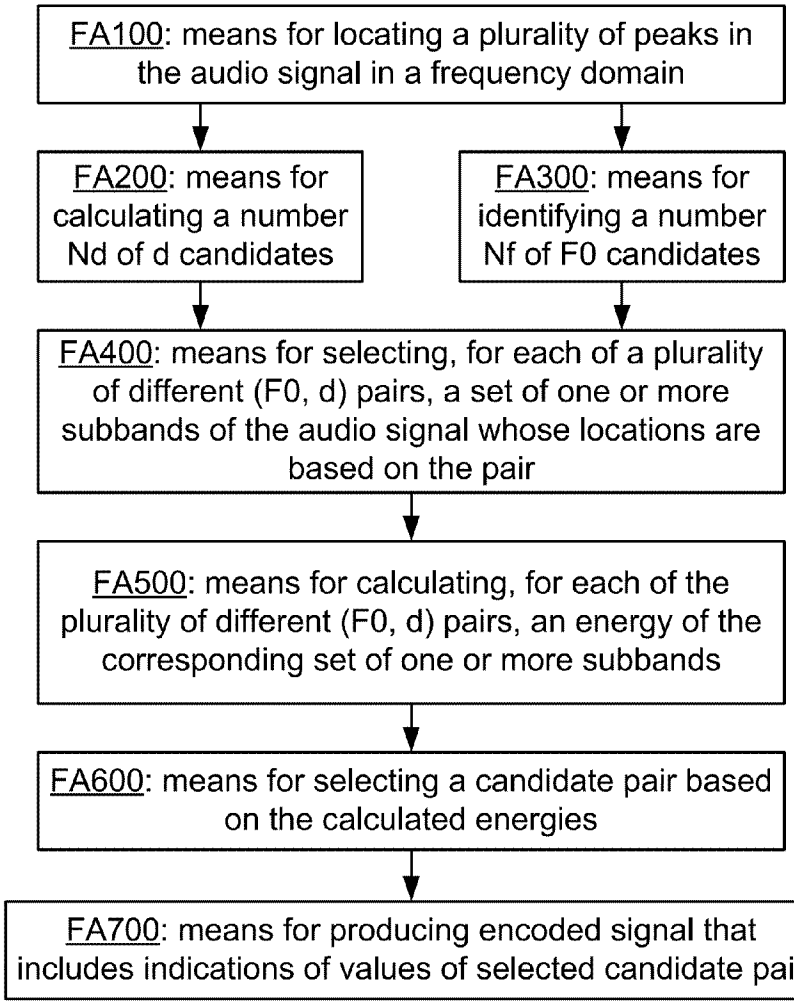
FIG. 13A shows a block diagram of an implementation MF110 of apparatus MF100.

FIG. 13B shows a block diagram of an implementation A110 of apparatus A100 that includes a quantizer 710 and a bit packer 720. Quantizer 710 is configured to encode the selected set of subbands (e.g., as described herein with reference to task TA700). For example, quantizer 710 may be configured to encode the subbands as vectors using a GSVQ or other VQ scheme. Bit packer 720 is configured to encode the values of the selected candidate pair (e.g., as described herein with reference to task TA700) and to pack these indications of the selected candidate values with the quantized subbands to produce an encoded signal. A corresponding decoder may include a bit unpacker configured to unpack the quantized subbands and decode the candidate values, a dequantizer configured to produce a dequantized set of subbands, and a subband placer configured to place the dequantized subbands in the frequency domain at locations that are based on the decoded candidate values (e.g., as described herein with reference to task TD300), and possibly also to place a corresponding residual, to produce a decoded signal. It is expressly noted that apparatus A110 may also be implemented such that its various elements are configured to perform corresponding tasks of method MB110 as described herein.

Figure 14:
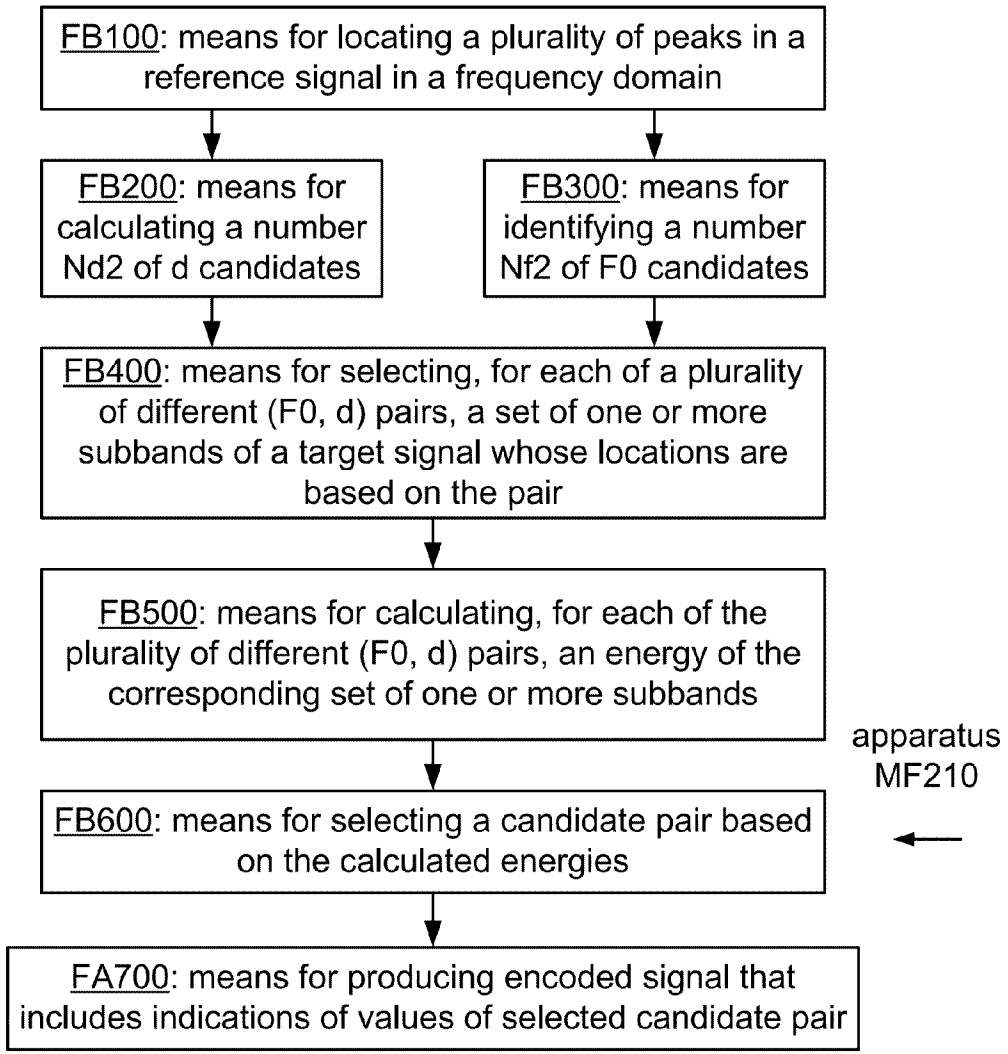
FIG. 14 shows a block diagram of an apparatus MF210 for processing an audio signal according to a general configuration.

FIG. 14 shows a block diagram of an apparatus for audio signal processing MF210 according to a general configuration. Apparatus MF210 includes means FB100 for locating a plurality of peaks in a reference audio signal in a frequency domain (e.g., as described herein with reference to task TB100). Apparatus MF210 also includes means FB200 for calculating a number Nd2 of harmonic spacing (d) candidates (e.g., as described herein with reference to task TB200). Apparatus MF210 also includes means FB300 for identifying a number Nf2 of fundamental frequency (F0) candidates (e.g., as described herein with reference to task TB300). Apparatus MF210 also includes means FB400 for selecting, for each of a plurality of different (F0, d) pairs, a set of subbands of a target audio signal whose locations are based on the pair (e.g., as described herein with reference to task TB400). Apparatus MF210 also includes means FB500 for calculating, for each of the plurality of different (F0, d) pairs, an energy of the corresponding set of subbands (e.g., as described herein with reference to task TB500). Apparatus MF210 also includes means FB600 for selecting a candidate pair based on the calculated energies (e.g., as described herein with reference to task TB600). Apparatus MF210 also includes means FB700 for producing an encoded signal that includes indications of the values of the selected candidate pair (e.g., as described herein with reference to task TB700).

For a case in which the reference signal (e.g., a lowband spectrum) is encoded using a harmonic model (e.g., an instance of method MA100), it may be desirable to perform an instance of MA100 on the target signal (e.g., a highband spectrum) rather than an instance of method MB100. In other words, it may be desirable to estimate highband values for F0 and d independently from the highband spectrum, rather than to map F0 from lowband values as with method MB100. In such case, it may be desirable to transmit the upper-band values for F0 and d to the decoder or, alternatively, to transmit the difference between the lowband and highband values for F0 and the difference between the lowband and highband values for d (also called "parameter-level prediction" of the highband model parameters).

Such independent estimation of the highband parameters may have an advantage in terms of error resiliency as compared to prediction of the parameters from the decoded lowband spectrum (also called "signal-level prediction"). In one example, the gains for the harmonic lowband subbands are encoded using an adaptive differential pulse-code-modulated (ADPCM) scheme which uses information from the two previous frames. Consequently, if any of the consecutive previous harmonic lowband frames are lost, the subband gain at the decoder may differ from that at the encoder. If signal-level prediction of the highband harmonic model parameters from the decoded lowband spectrum were used in such a case, the largest peaks may differ at the encoder and decoder. Such a difference may lead to incorrect estimates for F0 and d at the decoder, potentially producing a highband decoded result that is completely erroneous.

Figure 15B:
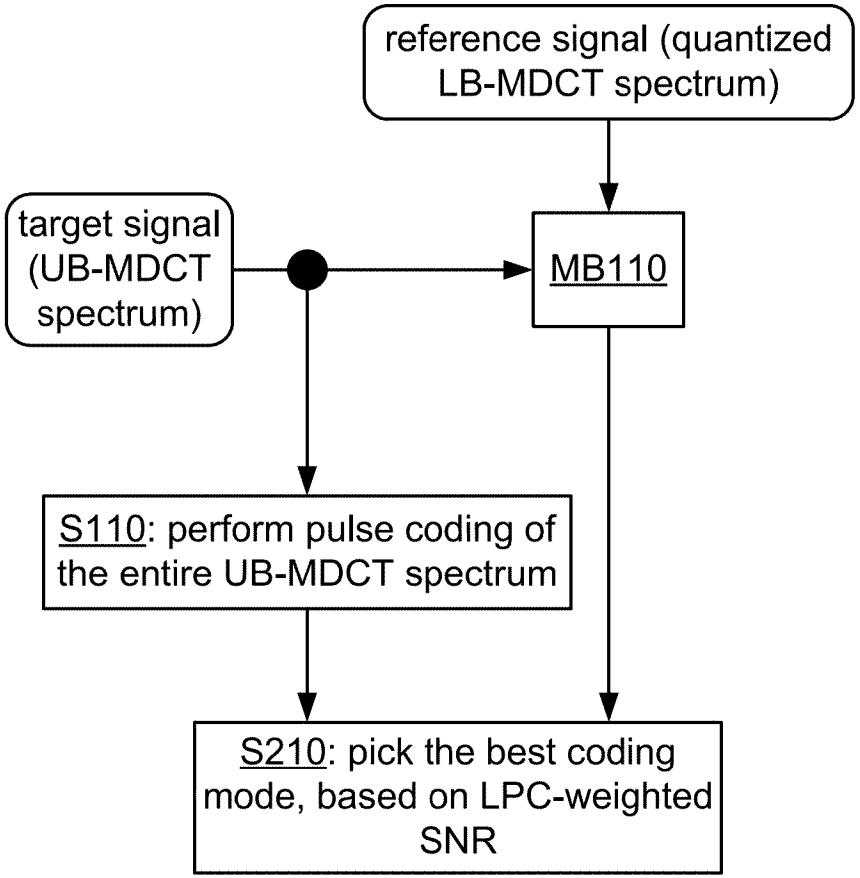
FIGS. 15A and 15B illustrate examples of applications of method MB110 to encoding target signals.
Figure 15A:
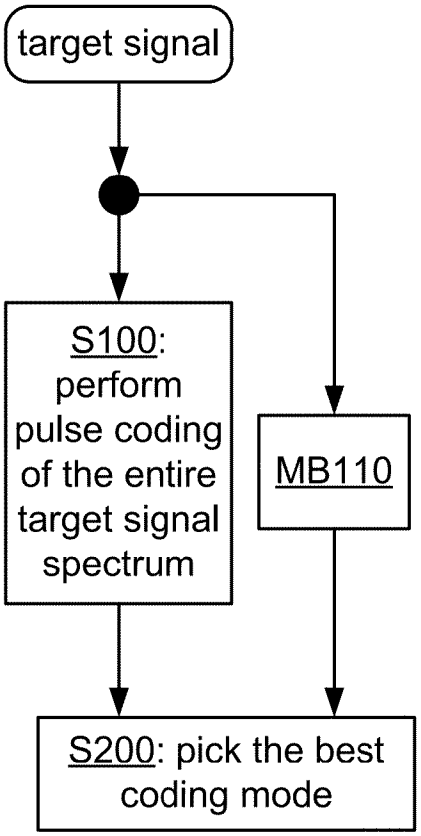

FIG. 15A illustrates an example of an application of method MB110 to encoding a target signal, which may be in an LPC residual domain. In the left-hand path, task S100 performs pulse coding of the entire target signal spectrum (which may include performing an implementation of method MA100 or MB100 on a residue of the pulse-coding operation). In the right-hand path, an implementation of method MB110 is used to encode the target signal. In this case, task TB700 may be configured to use a VQ scheme (e.g., GSVQ) to encode the selected subbands and a pulse-coding method to encode the residual. Task S200 evaluates the results of the coding operations (e.g., by decoding the two encoded signals and comparing the decoded signals to the original target signal) and indicates which coding mode is currently more suitable.

FIG. 15B shows a block diagram of a harmonic-model encoding system in which the input signal is the highband (upper-band, "UB") of an MDCT spectrum, which may be in an LPC residual domain, and the reference signal is a reconstructed LB-MDCT spectrum. In this example, an implementation S110 of task S100 encodes the target signal using a pulse coding method (e.g., a factorial pulse coding (FPC) method or a combinatorial pulse coding method). The reference signal is obtained from a quantized LB-MDCT spectrum of the frame that may have been encoded using a harmonic model, a coding model that is dependent on the previous encoded frame, a coding scheme that uses fixed subbands, or some other coding scheme. In other words, the operation of method MB110 is independent of the particular method that was used to encode the reference signal. In this case, method MB110 may be implemented to encode the subband gains using a transform code, and the number of bits allocated for quantizing the shape vectors may be calculated based on the coded gains and on results of an LPC analysis. The encoded signal produced by method MB110 (e.g., using GSVQ to encode subbands selected by the harmonic model) is compared to the encoded signal produced by task S110 (e.g., using only pulse coding, such as FPC), and an implementation S210 of task S200 selects the best coding mode for the frame according to a perceptual metric (e.g., an LPC-weighted signal-to-noise-ratio metric). In this case, method MB100 may be implemented to calculate the bit allocations for the GSVQ and residual encodings based on the subband and residual gains.

Coding mode selection (e.g., as shown in FIGS. 15A and 15B) may be extended to a multi-band case. In one such example, each of the lowband and the highband is encoded using both an independent coding mode (e.g., a GSVQ or pulse-coding mode) and a harmonic coding mode (e.g., method MA100 or MB100), such that four different mode combinations are initially under consideration for the frame. In such case, it may be desirable to calculate the residual for the lowband harmonic coding mode by subtracting the decoded subbands from the original signal as described herein. Next, for each of the lowband modes, the best corresponding highband mode is selected (e.g., according to comparison between the two options using a perceptual metric on the highband, such as an LPC-weighted metric). Of the two remaining options (i.e., lowband independent mode with the corresponding best highband mode, and lowband harmonic mode with the corresponding best highband mode), selection between these options is made with reference to a perceptual metric (e.g., an LPC-weighted perceptual metric) that covers both the lowband and the highband. In one example of such a multi-band case, the lowband independent mode uses GSVQ to encode a set of fixed subbands, and the highband independent mode uses a pulse coding scheme (e.g., factorial pulse coding) to encode the highband signal.

Figure 16:
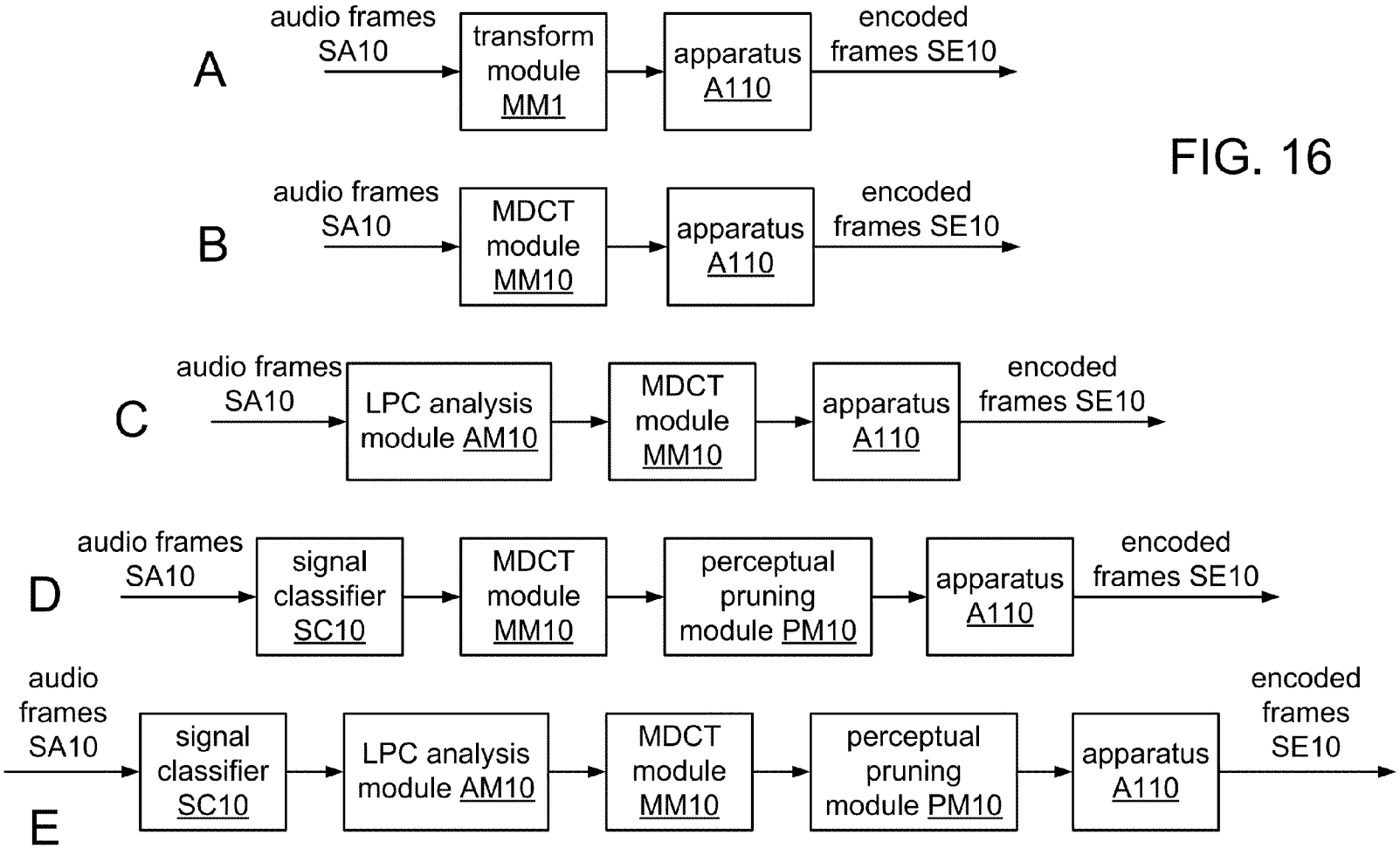
FIGS. 16A-E show a range of applications for various implementations of apparatus A110, MF110, or MF210.

FIGS. 16A-E show a range of applications for the various implementations of apparatus A110 (or MF110 or MF210) as described herein. FIG. 16A shows a block diagram of an audio processing path that includes a transform module MM1 (e.g., a fast Fourier transform or MDCT module) and an instance of apparatus A110 (or MF110 or MF210) that is arranged to receive the audio frames SA10 as samples in the transform domain (i.e., as transform domain coefficients) and to produce corresponding encoded frames SE10.

FIG. 16B shows a block diagram of an implementation of the path of FIG. 16A in which transform module MM1 is implemented using an MDCT transform module. Modified DCT module MM10 performs an MDCT operation on each audio frame to produce a set of MDCT domain coefficients.

FIG. 16C shows a block diagram of an implementation of the path of FIG. 16A that includes a linear prediction coding analysis module AM10. Linear prediction coding (LPC) analysis module AM10 performs an LPC analysis operation on the classified frame to produce a set of LPC parameters (e.g., filter coefficients) and an LPC residual signal. In one example, LPC analysis module AM10 is configured to perform a tenth-order LPC analysis on a frame having a bandwidth of from zero to 4000 Hz. In another example, LPC analysis module AM10 is configured to perform a sixth-order LPC analysis on a frame that represents a highband frequency range of from 3500 to 7000 Hz. Modified DCT module MM10 performs an MDCT operation on the LPC residual signal to produce a set of transform domain coefficients. A corresponding decoding path may be configured to decode encoded frames SE10 and to perform an inverse MDCT transform on the decoded frames to obtain an excitation signal for input to an LPC synthesis filter.

FIG. 16D shows a block diagram of a processing path that includes a signal classifier SC10. Signal classifier SC10 receives frames SA10 of an audio signal and classifies each frame into one of at least two categories. For example, signal classifier SC10 may be configured to classify a frame SA10 as speech or music, such that if the frame is classified as music, then the rest of the path shown in FIG. 16D is used to encode it, and if the frame is classified as speech, then a different processing path is used to encode it. Such classification may include signal activity detection, noise detection, periodicity detection, time-domain sparseness detection, and/or frequency-domain sparseness detection.

Figure 17A:
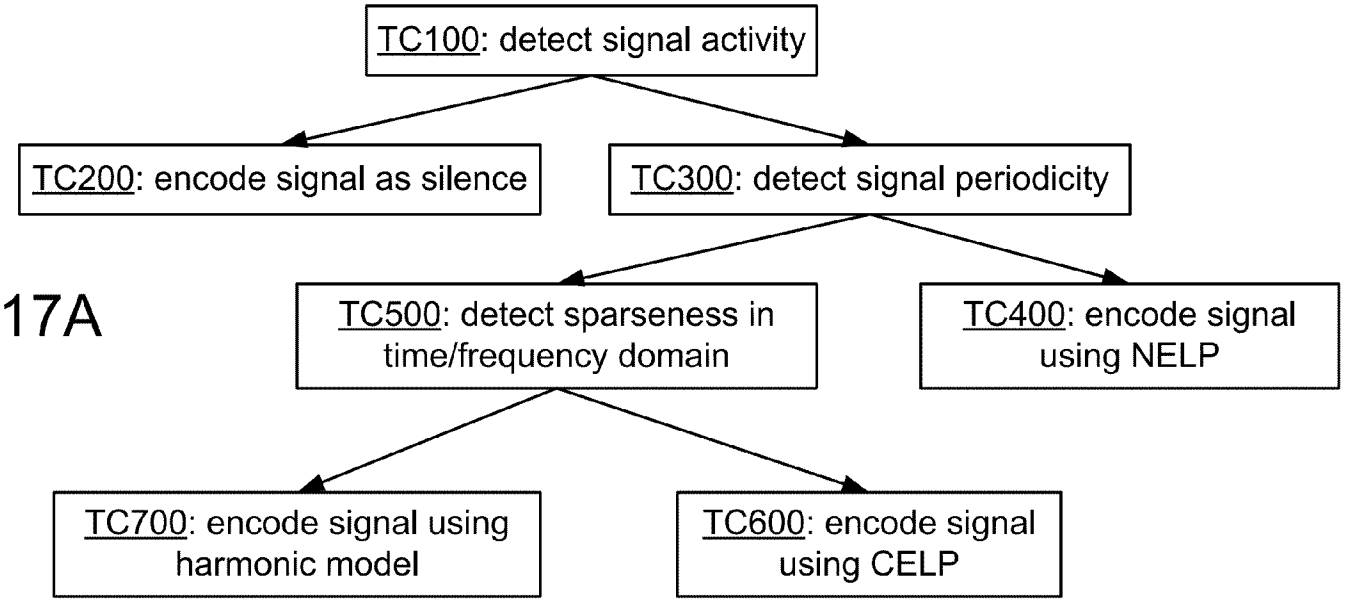
FIG. 17A shows a block diagram of a method MC100 of signal classification.

FIG. 17A shows a block diagram of a method MC100 of signal classification that may be performed by signal classifier SC10 (e.g., on each of the audio frames SA10). Method MC100 includes tasks TC100, TC200, TC300, TC400, TC500, and TC600. Task TC100 quantifies a level of activity in the signal. If the level of activity is below a threshold, task TC200 encodes the signal as silence (e.g., using a low-bit-rate noise-excited linear prediction (NELP) scheme and/or a discontinuous transmission (DTX) scheme). If the level of activity is sufficiently high (e.g., above the threshold), task TC300 quantifies a degree of periodicity of the signal. If task TC300 determines that the signal is not periodic, task TC400 encodes the signal using a NELP scheme. If task TC300 determines that the signal is periodic, task TC500 quantifies a degree of sparsity of the signal in the time and/or frequency domain. If task TC500 determines that the signal is sparse in the time domain, task TC600 encodes the signal using a code-excited linear prediction (CELP) scheme, such as relaxed CELP (RCELP) or algebraic CELP (ACELP). If task TC500 determines that the signal is sparse in the frequency domain, task TC700 encodes the signal using a harmonic model (e.g., by passing the signal to the rest of the processing path in FIG. 16D).

As shown in FIG. 16D, the processing path may include a perceptual pruning module PM10 that is configured to simplify the MDCT-domain signal (e.g., to reduce the number of transform domain coefficients to be encoded) by applying psychoacoustic criteria such as time masking, frequency masking, and/or hearing threshold. Module PM10 may be implemented to compute the values for such criteria by applying a perceptual model to the original audio frames SA10. In this example, apparatus A110 (or MF110 or MF210) is arranged to encode the pruned frames to produce corresponding encoded frames SE10.

FIG. 16E shows a block diagram of an implementation of both of the paths of FIGS. A1C and A1D, in which apparatus A110 (or MF110 or MF210) is arranged to encode the LPC residual.

Figure 17B:
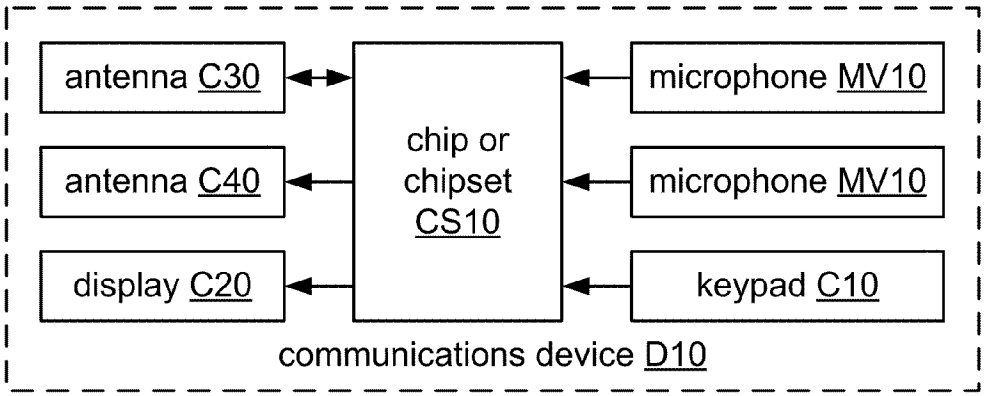
FIG. 17B shows a block diagram of a communications device D10.

FIG. 17B shows a block diagram of a communications device D10 that includes an implementation of apparatus A100. Device D10 includes a chip or chipset CS10 (e.g., a mobile station modem (MSM) chipset) that embodies the elements of apparatus A100 (or MF100 and/or MF210). Chip/chipset CS10 may include one or more processors, which may be configured to execute a software and/or firmware part of apparatus A100 or MF100 (e.g., as instructions).

Chip/chipset CS10 includes a receiver, which is configured to receive a radio-frequency (RF) communications signal and to decode and reproduce an audio signal encoded within the RF signal, and a transmitter, which is configured to transmit an RF communications signal that describes an encoded audio signal (e.g., as produced by task TA700 or TB700). Such a device may be configured to transmit and receive voice communications data wirelessly via one or more encoding and decoding schemes (also called "codecs"). Examples of such codecs include the Enhanced Variable Rate Codec, as described in the Third Generation Partnership Project 2 (3GPP2) document C.S0014-C, v1.0, entitled "Enhanced Variable Rate Codec, Speech Service Options 3, 68, and 70 for Wideband Spread Spectrum Digital Systems", February 2007 (available online at www-dot-3gpp-dot-org); the Selectable Mode Vocoder speech codec, as described in the 3GPP2 document C.S0030-0, v3.0, entitled "Selectable Mode Vocoder (SMV) Service Option for Wideband Spread Spectrum Communication Systems", January 2004 (available online at www-dot-3gpp-dot-org); the Adaptive Multi Rate (AMR) speech codec, as described in the document ETSI TS 126 092 V6.0.0 (European Telecommunications Standards Institute (ETSI), Sophia Antipolis Cedex, FR, December 2004); and the AMR Wideband speech codec, as described in the document ETSI TS 126 192 V6.0.0 (ETSI, December 2004).

Device D10 is configured to receive and transmit the RF communications signals via an antenna C30. Device D10 may also include a diplexer and one or more power amplifiers in the path to antenna C30. Chip/chipset CS10 is also configured to receive user input via keypad C10 and to display information via display C20. In this example, device D10 also includes one or more antennas C40 to support Global Positioning System (GPS) location services and/or short-range communications with an external device such as a wireless (e.g., Bluetooth™) headset. In another example, such a communications device is itself a Bluetooth™ headset and lacks keypad C10, display C20, and antenna C30.

Figure 18:
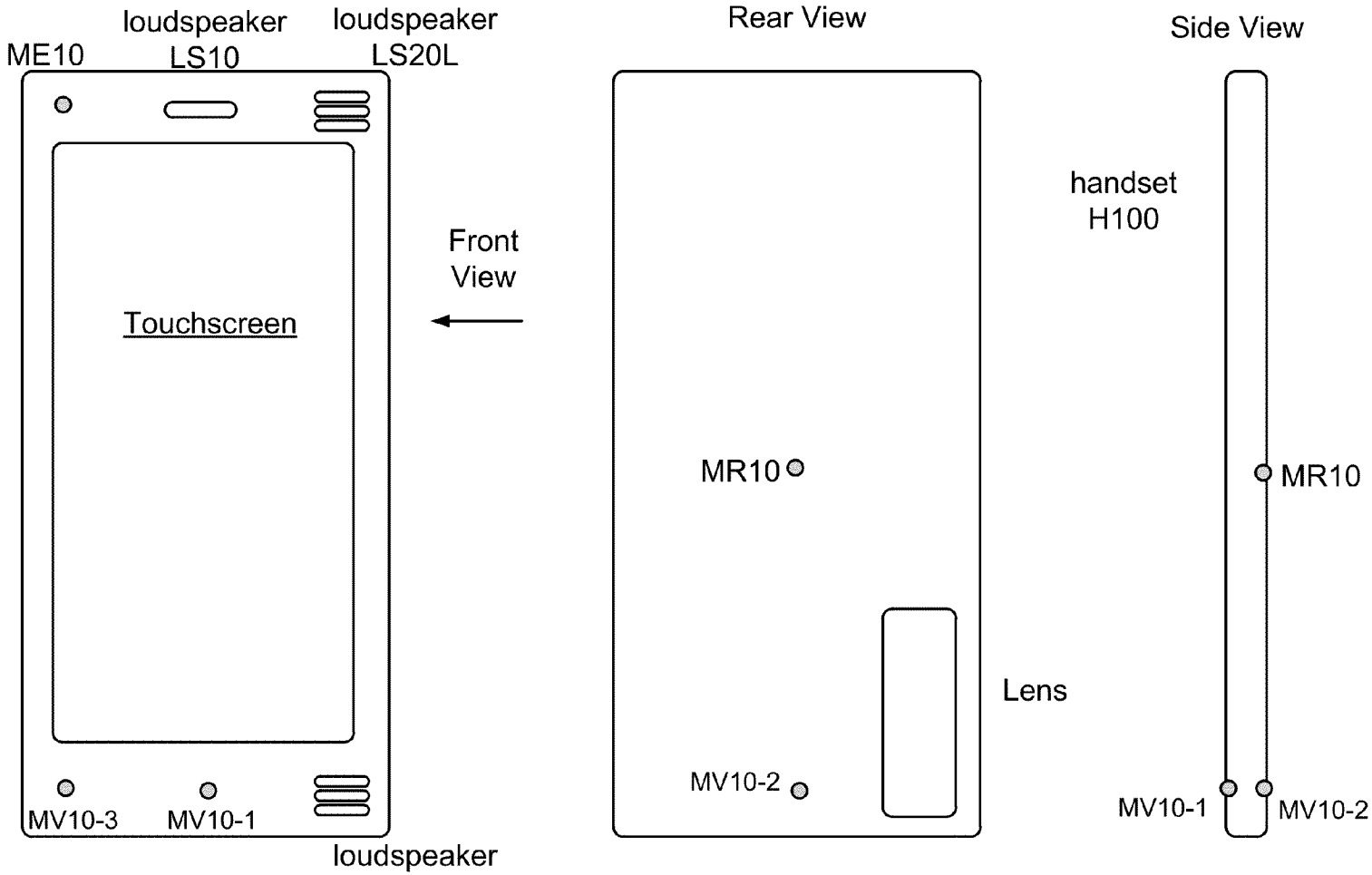
FIG. 18 shows front, rear, and side views of a handset H100.

Communications device D10 may be embodied in a variety of communications devices, including smartphones and laptop and tablet computers. FIG. 18 shows front, rear, and side views of a handset H100 (e.g., a smartphone) having two voice microphones MV10-1 and MV10-3 arranged on the front face, a voice microphone MV10-2 arranged on the rear face, an error microphone ME10 located in a top corner of the front face, and a noise reference microphone MR10 located on the back face. A loudspeaker LS10 is arranged in the top center of the front face near error microphone ME10, and two other loudspeakers LS20L, LS20R are also provided (e.g., for speakerphone applications). A maximum distance between the microphones of such a handset is typically about ten or twelve centimeters.

The methods and apparatus disclosed herein may be applied generally in any transceiving and/or audio sensing application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 44.1, 48, or 192 kHz).

An apparatus as disclosed herein (e.g., apparatus A100, A110, MF100, MF110, or MF210) may be implemented in any combination of hardware with software, and/or with firmware, that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein (e.g., apparatus A100, A110, MF100, MF110, or MF210) may be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a procedure of an implementation of method MA100, MA110, MB100, MB110, or MD100, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., methods MA100, MA110, MB100, MB110, or MD100) may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in tangible, computer-readable features of one or more computer-readable storage media as listed herein) as one or more sets of instructions executable by a machine including an array of logic elements (e.g., a processor, microprocessor, microcontroller, or other finite state machine). The term "computer-readable medium" may include any medium that can store or transfer information, including volatile, nonvolatile, removable, and non-removable storage media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk or any other medium which can be used to store the desired information, a fiber optic medium, a radio frequency (RF) link, or any other medium which can be used to carry the desired information and can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

The invention claimed is:

1. A method of audio signal processing, said method comprising:

in a frequency domain, locating a plurality of peaks in a reference audio signal;

selecting a number Nf of candidates for a fundamental frequency of a harmonic model, each based on the location of a corresponding one of the plurality of peaks in the frequency domain; based on the locations of at least two of the plurality of peaks in the frequency domain, calculating by a communications device a number Nd of candidates for a spacing between harmonics of the harmonic model;

for each of a plurality of different pairs of the fundamental frequency and harmonic spacing candidates, selecting by the communications device a set of at least one subband of a target audio signal, wherein a location in the frequency domain of each subband in the set is based on the pair of candidates;

for each of the plurality of different pairs of candidates, calculating an energy value from the corresponding set of at least one subband of the target audio signal; and based on at least a plurality of the calculated energy values, selecting a pair of candidates from among the plurality of different pairs of candidates, wherein at least one among the numbers Nf and Nd has a value greater than one.

2. The method according to claim 1, wherein said target audio signal is the reference audio signal.

3. The method according to claim 1, wherein said reference audio signal represents a first frequency range of an audio signal, and wherein said target audio signal represents a second frequency range of the audio signal that is different than the first frequency range.

4. The method according to claim 3, wherein said method includes mapping the number Nf of fundamental frequency candidates into the second frequency range.

5. The method according to claim 1, wherein said method includes performing a gain shape vector quantization operation on the set of at least one subband indicated by the selected pair of candidates.

6. The method according to claim 1, wherein said selecting at least one subband comprises selecting a set of subbands, and wherein said calculating an energy value from the corresponding set of subbands includes calculating an average energy per subband.

7. The method according to claim 1, wherein said calculating an energy value from the corresponding set of subbands includes calculating a total energy captured by the set of at least one subband.

8. The method according to claim 1, wherein said target audio signal is based on a linear prediction coding residual.

9. The method according to claim 1, wherein said target audio signal is a plurality of modified discrete cosine transform coefficients.

10. The method according to claim 1, wherein said selecting a set of at least one subband includes, for each of at least one of the set of at least one subband, finding a location for the subband, within a specified range of a reference location, at which the energy captured by the subband is maximum, wherein the reference location is based on the candidate pair.

11. The method according to claim 1, wherein said selecting a set of at least one subband includes, for each of at least one of the set of at least one subband, finding a location for the subband, within a specified range of a reference location, at which the sample having the maximum value within the subband is centered within the subband, wherein the reference location is based on the candidate pair.

12. The method according to claim 1, wherein, for at least one of the plurality of different pairs of candidates, said selecting a set of at least one subband includes, for each of at least one of the at least one subband:

based on the candidate pair, calculating a first location for the subband such that the subband excludes a specified one of the located peaks, wherein the first location is on one side of the specified located peak on a frequency-domain axis;

based on the candidate pair, calculating a second location for the subband such that the subband excludes the specified located peak, wherein the second location is on the other side of the specified located peak on the frequency-domain axis;

identifying the one among the first and second locations at which the subband has the lowest energy.

13. The method according to claim 1, wherein said method comprises producing an encoded signal that indicates the values of the selected pair of candidates and the contents of each subband of the corresponding selected set of at least one subband.

14. The method according to claim 1, wherein said selecting at least one subband comprises selecting a set of subbands, and wherein said method comprises:

quantizing the selected set of subbands that corresponds to the selected pair of candidates;

dequantizing the quantized set of subbands to obtain a dequantized set of subbands; and constructing a decoded signal by placing the dequantized subbands at corresponding locations that are based on the selected pair of candidates, wherein the locations of the dequantized subbands within the decoded signal differ from the locations, within the target audio signal, of the corresponding subbands of the selected set that corresponds to the selected pair of candidates.

15. A method of constructing a decoded audio frame, said method comprising:

placing by a communications device a first one of a plurality of decoded subband vectors according to a fundamental frequency value;

placing by the communications device the rest of the plurality of decoded subband vectors according to the fundamental frequency value and a harmonic spacing value; and inserting a decoded residual signal at locations of the frame that are not occupied by the plurality of decoded subband vectors.

16. The method according to claim 15, wherein, for each adjacent pair of the plurality of decoded subband vectors, a distance between the centers of the vectors is equal to the harmonic spacing value.

17. The method according to claim 15, wherein said method comprises erasing portions of the decoded residual signal that correspond to possible locations of the plurality of decoded subband vectors.

18. The method according to claim 15, wherein said inserting a decoded residual signal includes inserting values of the decoded residual signal, in order from a first value of the decoded residual signal to a last value of the decoded residual signal, at the unoccupied locations of the frame in order of increasing frequency.

19. The method according to claim 15, wherein said inserting a decoded residual signal includes warping a portion of the decoded residual signal with respect to a frequency-domain axis to fit between adjacent ones among the plurality of decoded subband vectors.

20. An apparatus for audio signal processing, said apparatus comprising:

means for locating a plurality of peaks in a reference audio signal in a frequency domain;

means for selecting a number Nf of candidates for a fundamental frequency of a harmonic model, each based on the location of a corresponding one of the plurality of peaks in the frequency domain;

means for calculating a number Nd of candidates for a spacing between harmonics of the harmonic model, based on the locations of at least two of the plurality of peaks in the frequency domain;

means for selecting, for each of a plurality of different pairs of the fundamental frequency and harmonic spacing candidates, a set of at least one subband of a target audio signal, wherein a location in the frequency domain of each subband in the set is based on the pair of candidates; and means for calculating, for each of the plurality of different pairs of candidates, an energy value from the corresponding set of at least one subband of the target audio signal; and means for selecting a pair of candidates from among the plurality of different pairs of candidates, based on at least a plurality of the calculated energy values, wherein at least one among the numbers Nf and Nd has a value greater than one.

21. The apparatus according to claim 20, wherein said target audio signal is the reference audio signal.

22. The apparatus according to claim 20, wherein said reference audio signal represents a first frequency range of an audio signal, and wherein said target audio signal represents a second frequency range of the audio signal that is different than the first frequency range.

23. The apparatus according to claim 22, wherein said apparatus includes means for mapping the number Nf of fundamental frequency candidates into the second frequency range.

24. The apparatus according to claim 20, wherein said apparatus includes means for performing a gain shape vector quantization operation on the set of at least one subband indicated by the selected pair of candidates.

25. The apparatus according to claim 20, wherein said means for selecting a set of at least one subband is configured to select, for each of the plurality of different pairs of candidates, a set of subbands, and wherein said means for calculating an energy value from the corresponding set of subbands includes means for calculating an average energy per subband.

26. The apparatus according to claim 20, wherein said means for calculating an energy value from the corresponding set of subbands includes means for calculating a total energy captured by the set of at least one subband.

27. The apparatus according to claim 20, wherein said target audio signal is based on a linear prediction coding residual.

28. The apparatus according to claim 20, wherein said target audio signal is a plurality of modified discrete cosine transform coefficients.

29. The apparatus according to claim 20, wherein said means for selecting a set of at least one subband includes means for finding, for each of at least one of the set of at least one subband, a location for the subband, within a specified range of a reference location, at which the energy captured by the subband is maximum, wherein the reference location is based on the candidate pair.

30. The apparatus according to claim 20, wherein said means for selecting a set of at least one subband includes means for finding, for each of at least one of the set of at least one subband, a location for the subband, within a specified range of a reference location, at which the sample having the maximum value within the subband is centered within the subband, wherein the reference location is based on the candidate pair.

31. The apparatus according to claim 20, wherein, for at least one of the plurality of different pairs of candidates, said means for selecting a set of at least one subband includes:

means for calculating, for each of at least one of the at least one subband and based on the candidate pair, (A) a first location for the subband such that the subband excludes a specified one of the located peaks, wherein the first location is on one side of the specified located peak on a frequency-domain axis, and (B) a second location for the subband such that the subband excludes the specified located peak, wherein the second location is on the other side of the specified located peak on the frequency-domain axis; and means for identifying, for each of said at least one of the at least one subband, the one among the first and second locations at which the subband has the lowest energy.

32. The apparatus according to claim 20, wherein said apparatus comprises means for producing an encoded signal that indicates the values of the selected pair of candidates and the contents of each subband of the corresponding selected set of at least one subband.

33. The apparatus according to claim 20, wherein said means for selecting a set of at least one subband is configured to select, for each of the plurality of different pairs of candidates, a set of subbands, and wherein said apparatus comprises:

means for quantizing the selected set of subbands that corresponds to the selected pair of candidates;

means for dequantizing the quantized set of subbands to obtain a dequantized set of subbands; and means for constructing a decoded signal by placing the dequantized subbands at corresponding locations that are based on the selected pair of candidates, wherein the locations of the dequantized subbands within the decoded signal differ from the locations, within the target audio signal, of the corresponding subbands of the selected set that corresponds to the selected pair of candidates.

34. An apparatus for audio signal processing, said apparatus comprising:

a frequency-domain peak locator configured to locate a plurality of peaks in a reference audio signal in a frequency domain, wherein the frequency-domain peak locator is implemented by the apparatus, and wherein the apparatus comprises hardware;

a fundamental-frequency candidate selector configured to select a number Nf of candidates for a fundamental frequency of a harmonic model, each based on the location of a corresponding one of the plurality of peaks in the frequency domain;

a distance calculator configured to calculate a number Nd of candidates for a spacing between harmonics of the harmonic model, based on the locations of at least two of the plurality of peaks in the frequency domain;

a subband placement selector configured to select, for each of a plurality of different pairs of the fundamental frequency and harmonic spacing candidates, a set of at least one subband of a target audio signal, wherein a location in the frequency domain of each subband in the set is based on the pair of candidates;

an energy calculator configured to calculate, for each of the plurality of different pairs of candidates, an energy value from the corresponding set of at least one subband of the target audio signal; and a candidate pair selector configured to select a pair of candidates from among the plurality of different pairs of candidates, based on at least a plurality of the calculated energy values, wherein at least one among the numbers Nf and Nd has a value greater than one.

35. The apparatus according to claim 34, wherein said target audio signal is the reference audio signal.

36. The apparatus according to claim 34, wherein said reference audio signal represents a first frequency range of an audio signal, and wherein said target audio signal represents a second frequency range of the audio signal that is different than the first frequency range.

37. The apparatus according to claim 36, wherein said subband placement selector is configured to map the number Nf of fundamental frequency candidates into the second frequency range.

38. The apparatus according to claim 34, wherein said apparatus includes a quantizer configured to perform a gain shape vector quantization operation on the set of at least one subband indicated by the selected pair of candidates.

39. The apparatus according to claim 34, wherein said subband placement selector is configured to select, for each of the plurality of different pairs of candidates, a set of subbands, and wherein said energy calculator is configured to calculate, for each of the plurality of different pairs of candidates, an average energy per subband.

40. The apparatus according to claim 34, wherein said energy calculator is configured to calculate, for each of the plurality of different pairs of candidates, a total energy captured by the set of at least one subband.

41. The apparatus according to claim 34, wherein said target audio signal is based on a linear prediction coding residual.

42. The apparatus according to claim 34, wherein said target audio signal is a plurality of modified discrete cosine transform coefficients.

43. The apparatus according to claim 34, wherein said subband placement selector is configured to find, for each of at least one of the set of at least one subband, a location for the subband, within a specified range of a reference location, at which the energy captured by the subband is maximum, wherein the reference location is based on the candidate pair.

44. The apparatus according to claim 34, wherein said subband placement selector is configured to find, for each of at least one of the set of at least one subband, a location for the subband, within a specified range of a reference location, at which the sample having the maximum value within the subband is centered within the subband, wherein the reference location is based on the candidate pair.

45. The apparatus according to claim 34, wherein, for at least one of the plurality of different pairs of candidates, said subband placement selector is configured to:

calculate, for each of at least one of the at least one subband and based on the candidate pair, (A) a first location for the subband such that the subband excludes a specified one of the located peaks, wherein the first location is on one side of the specified located peak on a frequency-domain axis, and (B) a second location for the subband such that the subband excludes the specified located peak, wherein the second location is on the other side of the specified located peak on the frequency-domain axis; and identify, for each of said at least one of the at least one subband, the one among the first and second locations at which the subband has the lowest energy.

46. The apparatus according to claim 34, wherein said apparatus comprises a bit packer configured to produce an encoded signal that indicates the values of the selected pair of candidates and the contents of each subband of the corresponding selected set of at least one subband.

47. The apparatus according to claim 34, wherein said subband placement selector is configured to select, for each of the plurality of different pairs of candidates, a set of subbands, and wherein said apparatus comprises:

a quantizer configured to quantize the selected set of subbands that corresponds to the selected pair of candidates;

a dequantizer configured to dequantize the quantized set of subbands to obtain a dequantized set of subbands; and subband placement logic configured to construct a decoded signal by placing the dequantized subbands at corresponding locations that are based on the selected pair of candidates, wherein the locations of the dequantized subbands within the decoded signal differ from the locations, within the target audio signal, of the corresponding subbands of the selected set that corresponds to the selected pair of candidates.

48. A non-transitory computer-readable storage medium having tangible features that when read by a machine cause the machine to:

locate, in a frequency domain, a plurality of peaks in a reference audio signal;

select a number Nf of candidates for a fundamental frequency of a harmonic model, each based on the location of a corresponding one of the plurality of peaks in the frequency domain;

based on the locations of at least two of the plurality of peaks in the frequency domain, calculate a number Nd of candidates for a spacing between harmonics of the harmonic model;

for each of a plurality of different pairs of the fundamental frequency and harmonic spacing candidates, select a set of at least one subband of a target audio signal, wherein a location in the frequency domain of each subband in the set is based on the pair of candidates;

for each of the plurality of different pairs of candidates, calculate an energy value from the corresponding set of at least one subband of the target audio signal; and based on at least a plurality of the calculated energy values, select a pair of candidates from among the plurality of different pairs of candidates, wherein at least one among the numbers Nf and Nd has a value greater than one.

49. An apparatus for constructing a decoded audio frame, said apparatus comprising:

a subband placer configured to place a first one of a plurality of decoded subband vectors according to a fundamental frequency value, to place the rest of the plurality of decoded subband vectors according to the fundamental frequency value and a harmonic spacing value, and to insert a decoded residual signal at locations of the frame that are not occupied by the plurality of decoded subband vectors.

50. The apparatus according to claim 49, wherein, for each adjacent pair of the plurality of decoded subband vectors, a distance between the centers of the vectors is equal to the harmonic spacing value.

51. The apparatus according to claim 49, wherein said subband placer is further configured to erase portions of the decoded residual signal that correspond to possible locations of the plurality of decoded subband vectors.

52. The apparatus according to claim 49, wherein said inserting a decoded residual signal includes inserting values of the decoded residual signal, in order from a first value of the decoded residual signal to a last value of the decoded residual signal, at the unoccupied locations of the frame in order of increasing frequency.

53. The apparatus according to claim 49, wherein said inserting a decoded residual signal includes warping a portion of the decoded residual signal with respect to a frequency-domain axis to fit between adjacent ones among the plurality of decoded subband vectors.

54. An apparatus for constructing a decoded audio frame, said apparatus comprising:

means for placing a first one of a plurality of decoded subband vectors according to a fundamental frequency value;

means for placing the rest of the plurality of decoded subband vectors according to the fundamental frequency value and a harmonic spacing value; and means for inserting a decoded residual signal at locations of the frame that are not occupied by the plurality of decoded subband vectors.

55. The apparatus according to claim 54, wherein, for each adjacent pair of the plurality of decoded subband vectors, a distance between the centers of the vectors is equal to the harmonic spacing value.

56. The apparatus according to claim 54, wherein said apparatus further comprises means for erasing portions of the decoded residual signal that correspond to possible locations of the plurality of decoded subband vectors.

57. The apparatus according to claim 54, wherein said inserting a decoded residual signal includes inserting values of the decoded residual signal, in order from a first value of the decoded residual signal to a last value of the decoded residual signal, at the unoccupied locations of the frame in order of increasing frequency.

58. The apparatus according to claim 54, wherein said inserting a decoded residual signal includes warping a portion of the decoded residual signal with respect to a frequency-domain axis to fit between adjacent ones among the plurality of decoded subband vectors.

* * * * *